US006962405B2

(12) United States Patent
Imanaka et al.

(10) Patent No.: US 6,962,405 B2
(45) Date of Patent: Nov. 8, 2005

(54) SUBSTRATE FOR INK JET RECORDING HEAD, INK JET RECORDING HEAD AND INK JET RECORDING APPARATUS USING INK JET RECORDING HEAD

(75) Inventors: Yoshiyuki Imanaka, Kanagawa (JP); Kei Fujita, Kanagawa (JP); Hiraku Kozuka, Kanagawa (JP); Mineo Shimotsusa, Tokyo (JP); Yukihiro Hayakawa, Kanagawa (JP); Takuya Hatsui, Kanagawa (JP); Muga Mochizuki, Kanagawa (JP); Souta Takeuchi, Kanagawa (JP); Takashi Morii, Kanagawa (JP); Takaaki Yamaguchi, Kanagawa (JP); Kousuke Kubo, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 166 days.

(21) Appl. No.: 10/636,643

(22) Filed: Aug. 8, 2003

(65) Prior Publication Data

US 2004/0160485 A1 Aug. 19, 2004

(30) Foreign Application Priority Data

Aug. 13, 2002 (JP) ..... 2002-235738

(51) Int. Cl.[7] ..... B41J 2/05
(52) U.S. Cl. ..... 347/58
(58) Field of Search ..... 347/12–14, 19, 347/20, 56–59, 61, 63, 65, 67

(56) References Cited

U.S. PATENT DOCUMENTS

| | | | | |
|---|---|---|---|---|
| 5,264,874 A | | 11/1993 | Matsumoto et al. | 347/59 |
| 5,376,231 A | | 12/1994 | Matsumoto et al. | 347/59 |
| 5,567,630 A | | 10/1996 | Matsumoto et al. | 347/59 |
| 5,943,070 A | | 8/1999 | Kamiyama et al. | 347/19 |
| 6,028,615 A | * | 2/2000 | Pletcher et al. | 347/127 |
| 6,243,111 B1 | | 6/2001 | Imanaka et al. | 347/13 |
| 6,257,695 B1 | | 7/2001 | Kamiyama et al. | 347/19 |
| 6,302,504 B1 | | 10/2001 | Imanaka et al. | 347/9 |
| 6,309,052 B1 | | 10/2001 | Prasad et al. | 347/57 |
| 6,357,862 B1 | | 3/2002 | Ozaki et al. | 347/58 |
| 6,422,676 B1 | | 7/2002 | Torgerson et al. | 374/13 |
| 6,468,437 B1 | | 10/2002 | Kashino et al. | 347/56 |
| 6,530,650 B2 | | 3/2003 | Ozaki et al. | 347/64 |

FOREIGN PATENT DOCUMENTS

| | | | |
|---|---|---|---|
| EP | 0816082 A2 | 1/1998 | |
| EP | 0924080 A2 | 6/1999 | |
| EP | 1122071 A2 | 8/2001 | |
| EP | 1221720 A2 | 7/2002 | |
| JP | 10-71713 | 3/1998 | B41J/2/05 |

* cited by examiner

*Primary Examiner*—Juanita D. Stephens
(74) *Attorney, Agent, or Firm*—Fitzpatrick, Cella, Harper & Scinto

(57) ABSTRACT

In a case where first wirings (wirings for a driving power supply (VH)) commonly connected to a plurality of electro-thermal converting elements and adapted to supply an electric power to the plurality of electro-thermal converting elements and second wirings (high voltage grounding wirings (GNDH)) for connecting source areas of respective switching elements to grounding potential are provided, resistance of the second wiring is selected to be smaller than resistance of the first wiring.

24 Claims, 21 Drawing Sheets

SUBSTRATE FOR INK JET RECORDING HEAD, INK JET RECORDING HEAD AND INK JET RECORDING APPARATUS USING INK JET RECORDING HEAD

BACKGROUND OF THE INVENTION

1. Field of the Invention

The present invention relates to a substrate for an ink jet recording head (referred to as "ink jet recording head substrate" hereinafter), which is used in an ink jet recording head for performing a recording operation by discharging an ink droplet from a discharge port and which includes an electro-thermal converting element for generating discharging energy, a switching element for driving the electro-thermal converting element and a logic circuit for controlling the switching element, an ink jet recording head having such an ink jet recording head substrate, and an ink jet recording apparatus using such an ink jet recording head.

2. Related Background Art

In accordance with an ink jet recording method for discharging ink from a discharge port by utilizing heat, an ink jet recording apparatus used as terminals for generating various outputs may include an ink jet recording head mounted thereon. The ink jet recording head includes an ink jet recording head substrate on which electro-thermal converting elements (heaters), elements for switching the electro-thermal converting elements (referred to as "switching elements" hereinafter) and logic circuits for driving the switching elements are commonly formed.

FIG. 21 is a schematic sectional view showing a portion of a conventional ink jet recording head. On a semiconductor substrate 901 formed from mono-crystal silicon, there are formed a p-type well area 912, an n-type drain area 908 having high impurity density, an n-type electric field relieving drain area 916 having low impurity density, an n-type source area 907 having high impurity density and a gate electrode 914, which constitute a switching element 930 utilizing an MIS-type electric field effect transistor. Further, on the surface of the semiconductor substrate 901, there are formed a silicon oxide film as a heat accumulating layer 917 and an insulation layer, tantalum nitride film as a heat-resistive layer 918, an aluminum alloy film as wirings 919 and a silicon nitride film as a protection layer 920. In this way, a substrate for the recording head. Here, a heat generating portion is designated by the reference numeral 950 and ink is discharged from an ink discharge portion 960 opposed to the heat generating portion 950. Further, a top plate 970 cooperates with the substrate to define a liquid path 980.

By the way, with respect to the recording head and the switching element having the above-mentioned constructions, although many improvements have been made, in recent years, as for the article or product, there have been requested a need for a high speed driving ability (arrangement of a larger number of electro-thermal converting elements), an energy saving ability (enhancement of an electric power consuming ratio at the electro-thermal converting element; high voltage driving), a high integrating ability (enhancement of arranging density of electro-thermal converting elements and switching elements arranged in parallel therewith), low cost achievement (enhancement of the substantial number of chips per one wafer by making a chip size smaller by reducing a size of the switching element per one electro-thermal converting element; identical voltage between motor power supply voltage (for example, 20 to 30 V) of main body and electro-thermal converting element driving voltage) and a high performance ability (enhancement of pulse control by performing high switching).

However, under a circumstance where large electric current is required for driving the load such as the electro-thermal converting element, if the conventional MIS-type electric field effect transistor 930 is operated, a pn reverse bias joint portion between the drain and the well cannot endure the high electric field to generate leak electric current, with the result that withstand voltage requested for the switching element cannot be satisfied. Further, if ON resistance of the MIS-type electric field effect transistor used as the switching element is great, due to useless consumption of the electric current, there arises a problem to be solved that the electric current required for driving the electro-thermal converting element cannot be obtained.

To the contrary, there has recently been proposed a technique in which DMOS (dual diffusion MOS) transistor which can be made small-sized is used as a driver. However, as will be described later, although the DMOS transistor has high drain withstand voltage, withstand voltage between the source and the substrate is not so high. Thus, in a case that the DMOS transistor is used as the switching element for the electro-thermal converting element, due to increase in source voltage caused by the product of the electric current flowing through the electro-thermal converting element and ground wiring resistance, break-down may occur between the source and the substrate.

Therefore, an object of the present invention is to provide a DMOS transistor capable of flowing large electric current and capable of obtaining high withstand voltage, high speed driving, energy saving and high integrating ability and capable of achieving low cost of entire recording apparatus and to provide means for preventing break-down between a source and a substrate which must be considered in a case where the DMOS transistor is used as a switching element for an electro-thermal converting element.

SUMMARY OF THE INVENTION

An ink jet recording head substrate according to the present invention includes a first conductive-type semiconductor substrate on which a plurality of electro-thermal converting elements, first wirings commonly connected to the plurality of electro-thermal converting elements and connected to a driving power supply and adapted to supply an electric power to the plurality of electro-thermal converting elements, second wirings for connecting the plurality of electro-thermal converting elements to grounding potential, and a plurality of switching elements provided between the second wirings and the electro-thermal converting elements and adapted to establish electrical connection to the plurality of electro-thermal converting elements are provided, and is characterized in that the switching element is an insulation gate type electric field effect transistor including a second conductive-type first semiconductor area provided on one main surface of the semiconductor substrate, a first conductive-type second semiconductor area provided on the surface of the semiconductor substrate adjacent to the first semiconductor area to provide a channel area and comprised of semiconductor having impurity density higher than that of the first semiconductor area, a second conductive-type source area partially provided on a surface of the second semiconductor area opposed to the semiconductor substrate, a second conductive-type drain area partially provided on a surface of the first semiconductor area opposed to the semiconductor substrate and a gate electrode provided on the channel area via a gate insulation film and in that wiring resistance of the second wiring connected to the source area is smaller than wiring resistance of the first wiring connected to the drain area.

The ink jet recording head substrate of the present invention constructed in this way typically utilizes a semiconductor substrate mainly comprising a p-type semiconductor area as the semiconductor substrate. For example, in the ink jet recording substrate of the present invention, a plurality of electro-thermal converting elements, first wirings commonly connected to the plurality of electro-thermal converting elements and connected to a driving power supply and adapted to supply an electric power to the plurality of electro-thermal converting elements, second wirings for connecting the plurality of electro-thermal converting elements to grounding potential, and a plurality of switching elements provided between the second wirings and the electro-thermal converting elements and adapted to establish electrical connection to the plurality of electro-thermal converting elements are integrated on a semiconductor substrate, and the semiconductor substrate is a semiconductor substrate mainly comprising a p-type area, and the switching element is an insulation gate type electric field effect transistor including an n-type semiconductor area provided on a surface of a p-type area of the semiconductor substrate, a p-type semiconductor area extending through the n-type semiconductor area to the surface of the p-type semiconductor area of the semiconductor substrate to provide a channel area and comprised of semiconductor having impurity density higher than that of the n-type semiconductor area, a high density n-type source area partially provided on the surface of the p-type semiconductor area, a high density n-type drain area partially provided on a surface of the n-type semiconductor area and a gate electrode provided on the channel area via a gate insulation film, and wiring resistance of the second wiring connected to the source area is smaller than wiring resistance of the first wiring connected to the drain area. With this arrangement, even in a case where an element such as a DMOS transistor in which pressure resistance between the source and the substrate (well) is relatively small is used, breakdown at the switching element can positively be prevented.

In the present invention, the second semiconductor area may be formed in adjacent to the semiconductor substrate.

Further, a wiring width of the first wiring may be greater than a wiring width of the second wiring. The source areas and the drain areas may be alternately arranged in a lateral direction. Two gate electrodes may be installed with the interposition of the source area. The arranging direction of the plurality of the electro-thermal converting elements may be in parallel with the arranging direction of the plurality of the switching elements. The drain areas of at least two insulation gate type electric field effect transistors may be connected to one electro-thermal converting element and the source areas of the plurality of the insulation gate type electric field effect transistors may be connected commonly. A length of an effective channel of the insulation gate type electric field effect transistor may be determined by a difference in an impurity diffusing amount in a lateral direction between the second semiconductor area and the source area.

Further, the electro-thermal converting elements may have a plurality of heat generating elements electrically connected in series and the plurality of heat generating elements connected in series may be disposed in adjacent to each other. Here, typically, the number of the heat generating elements connected in series is two. The electro-thermal converting element is formed from tantalum nitride silicon material having specific resistance equal to or greater than 450 $\mu\Omega\cdot$cm and it is preferable that sheet resistance is equal to or greater than 70 $\Omega/\square$.

It is preferable that voltage of a power supply for supplying the energy to the electro-thermal converting element of the ink jet recording head is the same as voltage of a power supply for supplying energy to the motor for driving the ink jet recording head.

DESCRIPTION OF THE PREFERRED EMBODIMENTS

Figure 1:
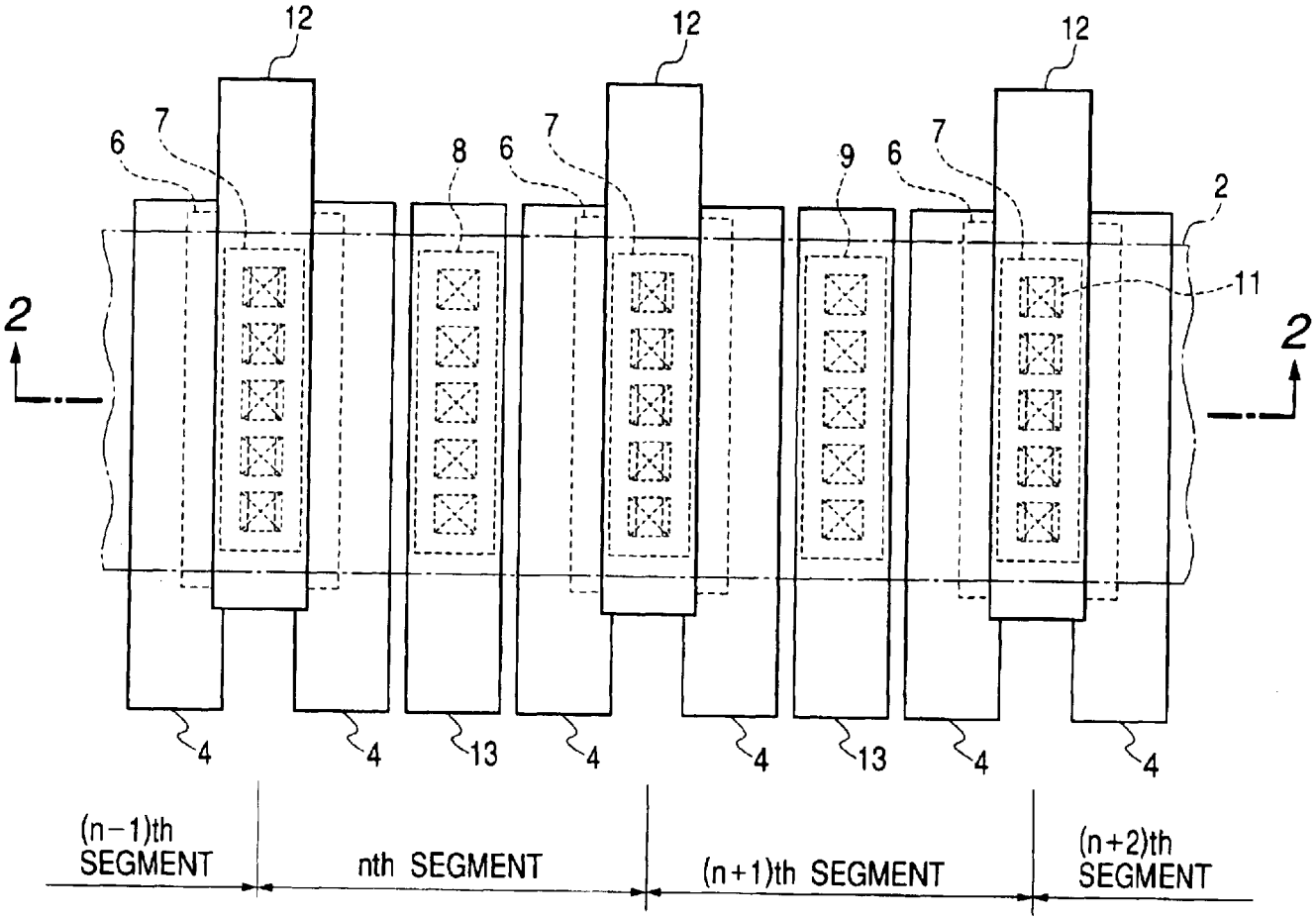
FIG. 1 is a partial plan view of an ink jet recording head substrate according to a first embodiment of the present invention.

Next, preferred embodiments of the present invention will be explained with reference to the accompanying drawings.

(First Embodiment)

First of all, an ink jet recording head substrate for a liquid discharging apparatus according to a first embodiment of the present invention will be fully explained with reference to FIGS. 1 to 4.

N-type well areas (first semiconductor areas) 2, gate electrodes 4, p-type base areas (second semiconductor areas) 6, n-type source areas 7, n-type drain areas 8 and 9, contacts 11, source electrodes 12 and drain electrodes 13 are formed on a p-type semiconductor substrate 1. An area encircled by the dot and chain line indicates an insulation gate type electric field effect transistor as a switching element 30. As shown in an equivalent circuit of FIG. 4, one ends of electro-thermal converting elements 31 to 33 as loads are respectively connected to drains of insulation gate electric field effect transistors Tr1, Tr2 and Tr3 as the switching elements source-grounded. The other ends of the electro-thermal converting elements 31 to 33 are commonly connected to power supply voltage VH for the electro-thermal converting element. Switches 34 to 36 for applying gate voltage VG are connected to gates of the insulation gate electric field effect transistors Tr1, Tr2 and Tr3.

Figure 2:
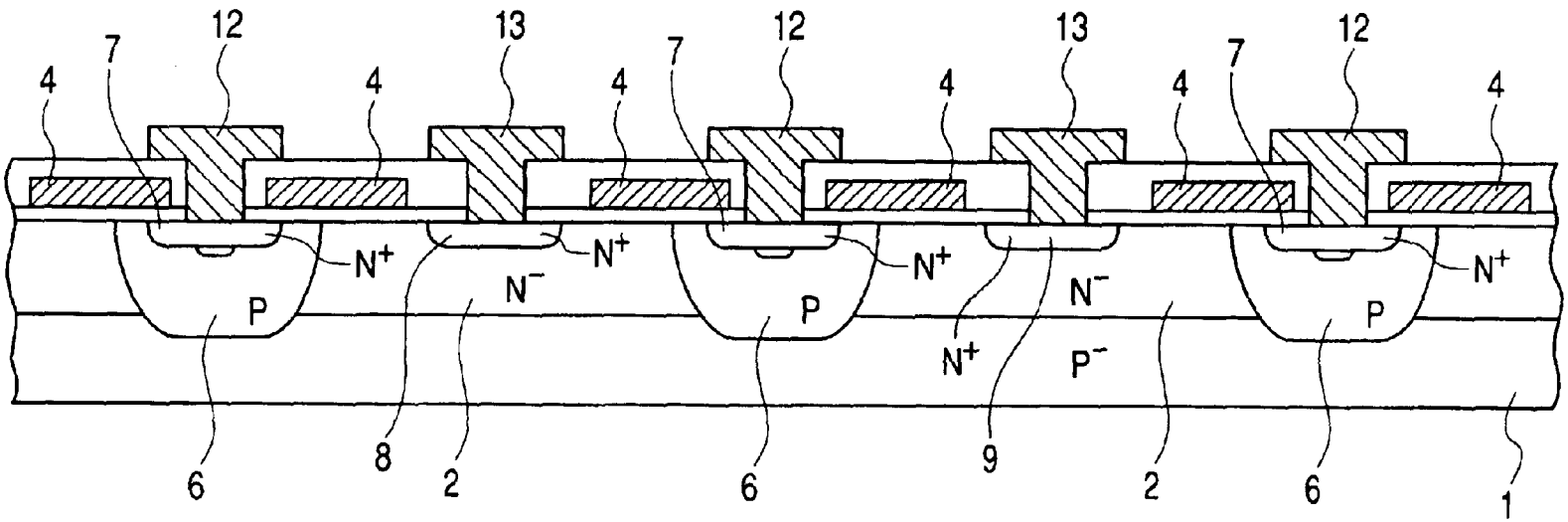
FIG. 2 is a sectional view of the ink jet recording head substrate shown in FIG. 1.
Figure 3:
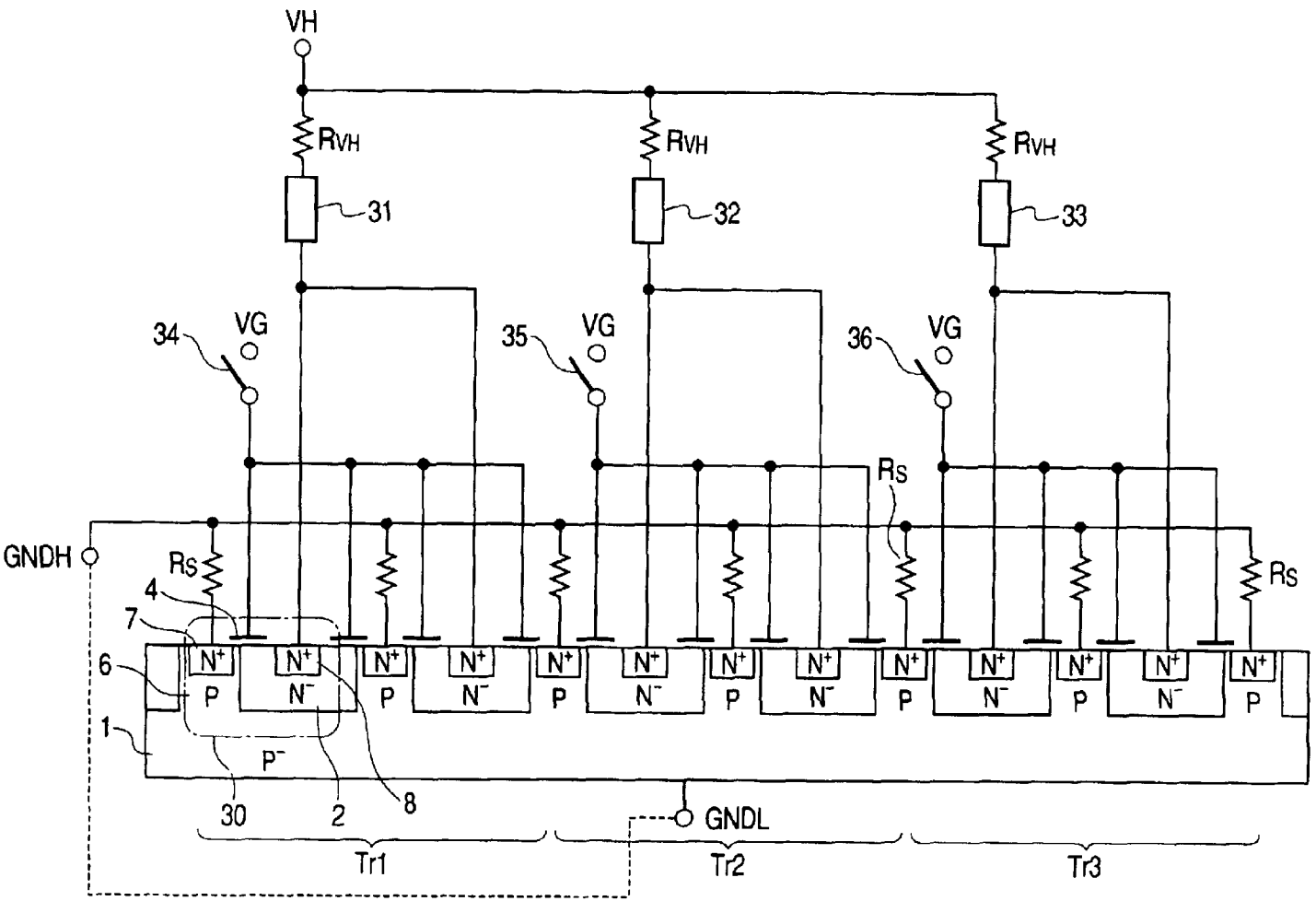
FIG. 3 is a view showing an operation circuit of the ink jet recording head substrate shown in FIG. 1.

The electro-thermal converting elements 31 to 33 are formed and integrated on a main surface of the semiconductor substrate 1 by a thin film process. Similarly, the switching elements Tr1 to Tr3 are arranged on the main surface of the semiconductor substrate 1. If desired, when an arranging direction of the electro-thermal converting elements is in parallel with an arranging direction of the switching elements, integrating accuracy and ability can be further enhanced. Further, in this case, it is preferable that the switching elements are arranged as shown in FIGS. 1 to 3. Here, constructions of the transistors connected to the electro-thermal converting elements are all identical, and it is designed so that no exclusive element separating areas are required between the transistors in a transistor array.

One segment is constituted or designed so that two gate electrodes and two source areas are arranged with the interposition of the drain area, and, in this case, the source area is communized with the adjacent segment.

In an example shown in. FIG. 3, the drains of two segments are connected to first terminals of the electro-thermal converting elements and the common source is connected to a low reference voltage source (GNDH) for supplying relatively low reference voltage such as 0 V (grounding potential). The other terminals of the electro-thermal converting elements are connected to a power supply for supplying relatively high reference voltage (power supply voltage) such as about +10 to +30 V.

Now, an operation of the ink jet recording head substrate will be briefly explained. The reference voltage such as the grounding potential is applied to the p-type semiconductor substrate 1 and the source areas 7. High power supply voltage VH is supplied to the first terminals of the electro-thermal converting elements 31 to 33. In this case, for example, if the electric current is applied to the electro-thermal converting element 31 alone, only the switch 34 is turned ON so that the gate voltage VG is supplied to the gates of the transistors of two segments constituting the switching element Tr1, thereby turning the switching element Tr1 ON. As a result, the electric current flows from the power supply terminal to the grounding terminal through the electro-thermal converting element 31 and the switching element Tr1, with the result that heat is generated in the electro-thermal converting element 31. As is well known, this heat is utilized for discharging liquid.

In the illustrated embodiment, as shown in FIG. 2, the base areas 6 are formed to separate the well areas 2 formed adequately deeply in a lateral direction. In the transistor 30, the well area 2 and the base area 6 act as a drain and a channel, respectively. Thus, to the contrary that the drains are formed after the semiconductor areas constituting the channels were formed as is in the normal MOS transistor, since the channels are formed after the drains were formed, it is possible to set impurity density of the drain (here, donor density of the first semiconductor area 2) to become lower than impurity density of the channel (here, acceptor density of the second semiconductor area 6). The withstand voltage of the transistor is determined by the withstand voltage of this drain, and, normally, the lower the density of the drain and the deeper the depth of the drain, the greater the withstand voltage. Thus, according to the illustrated embodiment, the rated voltage can be set to be higher and the large electric current can be used, thereby realizing a high speed operation.

Further, an effective channel length of the transistor 30 according to the illustrated embodiment is determined by a difference in a lateral diffusing amount of the impurity between the base area 6 and the source area 7. Since the lateral diffusing amount is determined on the basis of physical coefficients, the effective channel length can be set to become smaller than the conventional ones, with the result that ON resistance can be reduced. The reduction of the ON resistance leads to increase in an amount capable of flowing the electric current per unit size, thereby permitting the high speed operation, energy saving and high integrating ability.

Further, since two gate electrodes 4 are disposed with the interposition of the source area 7 and both of the base area 6 and the source area 7 can be formed in a self-aligning manner by using the gate electrode 4 as a mask as will be described later, there is no dimensional difference due to alignment and the switching elements (transistors) 30 can be manufactured without dispersion of a threshold value and high through-put can be realized and high reliability can be obtained.

Further, the base area 6 reaches the underlying p-type semiconductor substrate 1 to separate the well areas 2 completely and the base area is formed to have a depth sufficient that the bottom of the base area is adjacent to the substrate 1. With this construction, the drains of the respective segments can individually be separated from each other electrically. Thus, as shown in FIGS. 1 to 3, even if the source areas 7 and the drain areas 8, 9 are alternately arranged in the lateral direction without using the exclusive element separating areas, the operations of the switching elements are not obstructed.

Further, although not shown in FIGS. 1 and 2, a diffusing layer for taking out a potential of the p-type semiconductor substrate 1 is provided, so that the base area 2 can be maintained to a predetermined potential via the diffusing layer and the p-type semiconductor substrate 1. In FIG. 3, the potential taking-out diffusing layer is connected to a ground wiring (GNDL) for defining the potential of the p-type semiconductor substrate 1.

Figure 4:
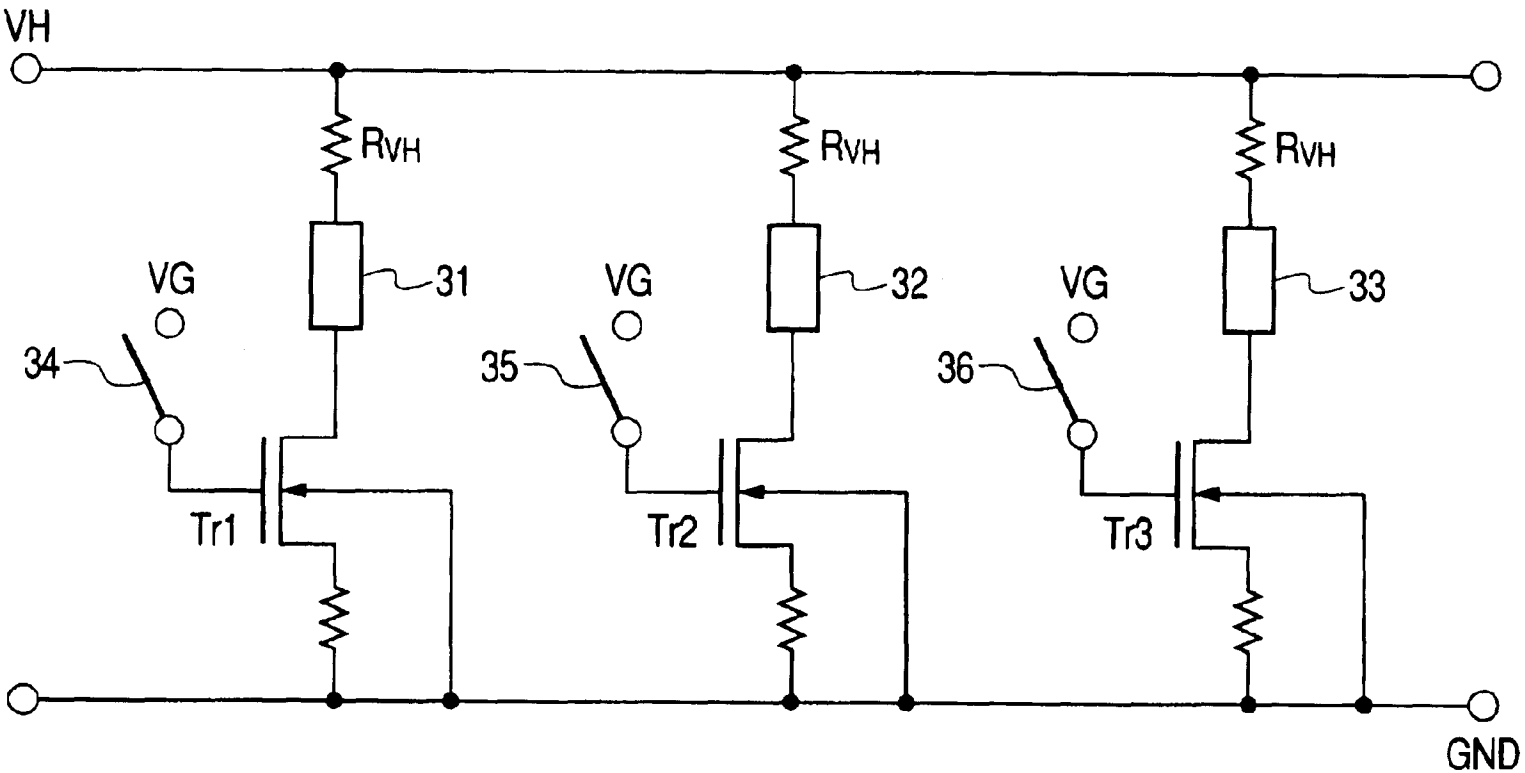
FIG. 4 is a view showing an equivalent circuit of the ink jet recording head substrate shown in FIG. 1.

In the embodiment shown in FIGS. 3 and 4, an example that two drains (two segments) of the transistors connected in parallel are connected to one load which can be driven independently. When an ON signal for driving the load is applied to the gate, the transistor is turned ON, so that the electric current flows from one drain to the communized source through the channels on both sides of the drain. As mentioned above, between the adjacent segments, the source located at the boundary can be used commonly. Thus, in a case where the transistors according to the illustrated embodiment are arranged as an array to be used as a liquid discharging apparatus, exclusive element separating areas comprised of pn joint separating semiconductor or LOCOS or trench separating dielectric body are not required to be provided between the transistors specially, with the result that a highly integrated ink jet recording head substrate capable of flowing large electric current can be realized with a simple layer structure as shown in FIGS. 2 and 3, thereby reducing the cost.

In addition, leak current flowing from the drains to the p-type semiconductor substrate 1 can be controlled well.

The inventors have discovered that a new problem to be considered arises by constructing the insulation gate type electric field effect transistor as the switching element 30 mounted to the ink jet recording head substrate to have the above-mentioned construction (DMOS transistor).

That is to say, the problem is reduction in withstand voltage between the source area and the substrate. This problem can be considered as a problem inherent to the ink jet recording head substrate.

Now, this will be fully explained.

Figure 5:
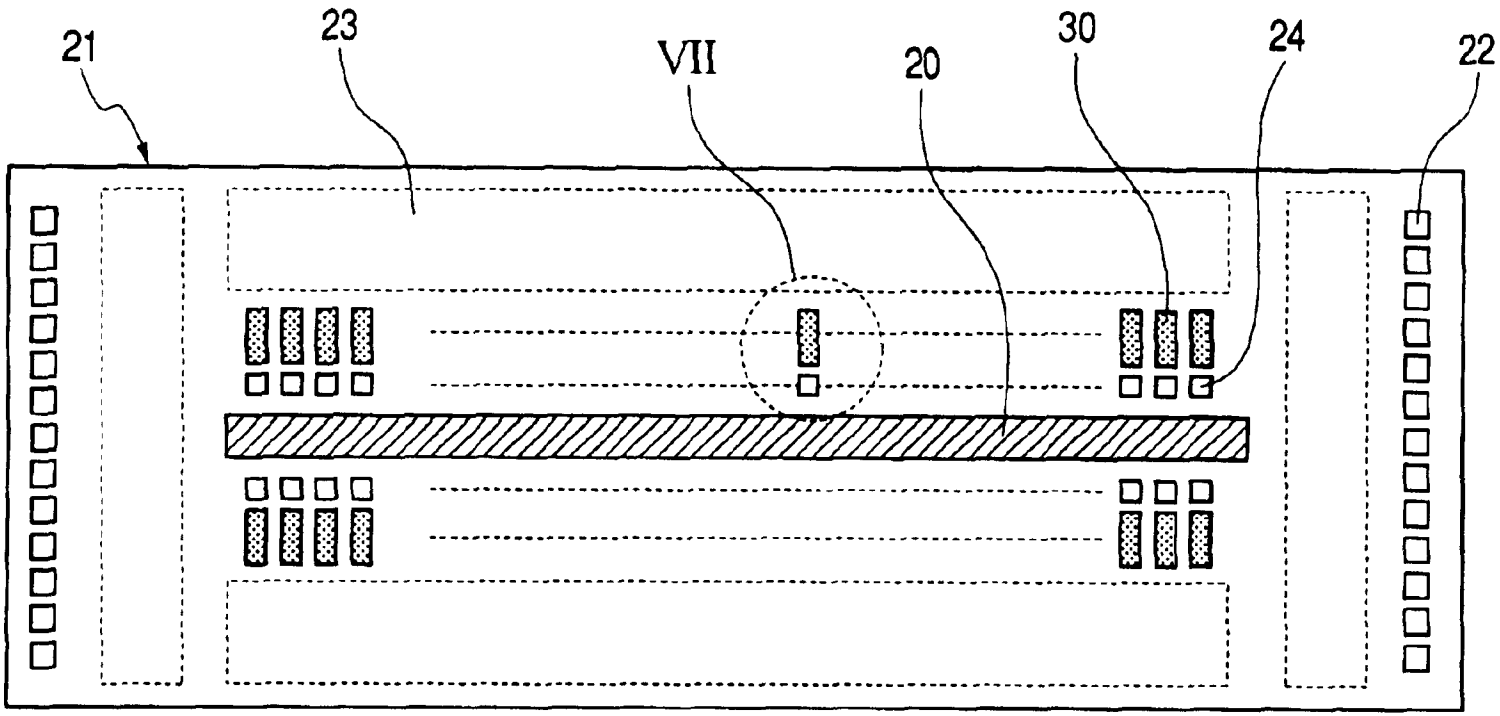
FIG. 5 is a plan view of an ink jet recording head according to a first embodiment of the present invention.

FIG. 5 is a plan view showing an arrangement of various elements on the ink jet recording head substrate. The ink jet recording head substrate 21 has a substantially rectangular shape and an ink supply port 20 as a through-hole extending in a longitudinal direction is formed at a center of the substrate. Along both sides of the ink supply port 20, a plurality of electro-thermal converting elements 24 (corresponding to the electro-thermal converting elements 31 to 33 in FIGS. 3 and 4) are provided. The electro-thermal converting element 24 serves to heat liquid (ink) supplied from a rear surface side of the ink jet recording head substrate 21 through the ink supply port 20 to generate a bubble in the liquid, thereby discharging an ink droplet from a discharge port provided in a confronting relationship to the electro-thermal converting element. At a side of each electro-thermal converting element 24 remote from the ink supply port 20, a corresponding switching element 30 is provided. Further, on the ink jet recording head substrate 21, there are provided logic circuit portions 23 and a plurality of pads 22 for supplying a power supply and a signal from a main body of the recording apparatus to the ink jet recording head substrate 21. The logic circuit portion 23 includes a logic circuit for controlling ON/Off of the switching element 30 on the basis of a signal when such a signal is supplied from the main body of the recording apparatus via the pad 22.

Here, regarding FIG. 3, while an example that, merely by applying the reference voltage such as the grounding potential to the p-type semiconductor substrate 1 and the source areas 7, the high reference voltage (power supply voltage) VH to the first terminals of the electro-thermal converting elements 31 to 33 was explained, in the actual ink jet recording head substrate as shown in FIG. 5, the plural electro-thermal converting elements corresponding to several hundreds of nozzles are arranged in a line and a combination of wiring resistances are selected so that energy values supplied to all of the electro-thermal converting elements become the identical.

As shown in FIG. 5, a wiring length from the pad 22 to the electro-thermal converting element 24 differs from the electro-thermal converting element to the electro-thermal converting element, and, thus, in this condition, the wiring resistances will differ from each other. If the wiring resistances differ from each other, heat generating amounts obtained by the electro-thermal converting elements 24 also differ from each other, with the result that ink discharge amounts from the respective discharge ports will become uneven. Accordingly, in the ink jet recording head substrate, a combination of the wiring resistances is selected so that the wiring resistances of the respective electro-thermal converting elements become similar as much as possible even when the wiring lengths differ from each other, for example, by changing wiring widths in a stepping manner. Since such a combination of the wiring resistances is performed on the basis of the electro-thermal converting element having the high wiring resistance relatively as a reference, as a whole, the wiring resistances of the electro-thermal converting elements are set to relatively high.

In FIGS. 3 and 4, the wiring resistances from the pads 22 at the power supply voltage VH side to the electro-thermal converting elements 31 to 33 are shown as resistances $R_{VH}$.

Since the electro-thermal converting elements 31 to 33 and the corresponding switching elements 30 (transistors Tr1 to Tr3) are disposed closely adjacent to each other, wiring resistances therebetween can be neglected. The wiring resistances from the sources of the transistors Tr1 to Tr3 to the grounding (GND) pads 22 are shown as resistances $R_S$. In particular, the wiring resistances $R_S$ at the transistors Tr1 to Tr3 act as source resistances to the switching elements 30. As a result, potential difference represented by product of the resistance value and an electric current value flowing through the electro-thermal converting element (i.e. drain electric current of the switching element 30) is generated between the source area of the switching element 30 and the grounding (GND) terminal of the electro-thermal converting element. On the other hand, the grounding wiring (GNDL) for defining the potential of the p-type semiconductor substrate 1 is a wiring independent from the electro-thermal converting elements, so that change in potential due to the electric current flowing through the electro-thermal converting element does not occur in this wiring fundamentally. Accordingly, in an aspect of the normal ink jet recording head substrate, when the electro-thermal converting element is driven, reverse bias is applied to the pn joint between the p-type semiconductor substrate 1, i.e. the p-type base area (second semiconductor area) 6 of the switching element 30 and the source area 7 of the switching element 30. Incidentally, the ground (GNDH) of the electro-thermal converting element and the substrate potential defining ground wiring (GNDL) are electrically connected as shown by the broken line, and a connecting site thereof is not on the ink jet recording head substrate but generally at the side of the main body of the recording apparatus. Thus, the wiring resistance of the routing of the ground (GNDH) wiring of the electro-thermal converting element and generation of potential thereby cannot be neglected.

Now, in the present invention, as mentioned above, the DMOS transistor arrangement is adopted, and, in the switching element 30, the impurity density of the p-type base area (second semiconductor area) 6 is set to be greater than the impurity density of the well area 2 in order to achieve high withstand pressure, energy saving and miniaturization. Although this construction leads to the high withstand pressure, energy saving and miniaturization, since the p-type impurity density is relatively high, the reverse bias withstand pressure between the source area 7 and the p-type base area 6 is reduced in comparison with the conventional cases.

Now, with reference to FIGS. 6A and 6B, necessity for considering the withstand pressure between the source area and the substrate in a case where the above-mentioned DMOS transistor is used as the switching element will be explained, while comparing with a conventional case where the MIS-type electric field effect transistor is used.

Figure 6B:
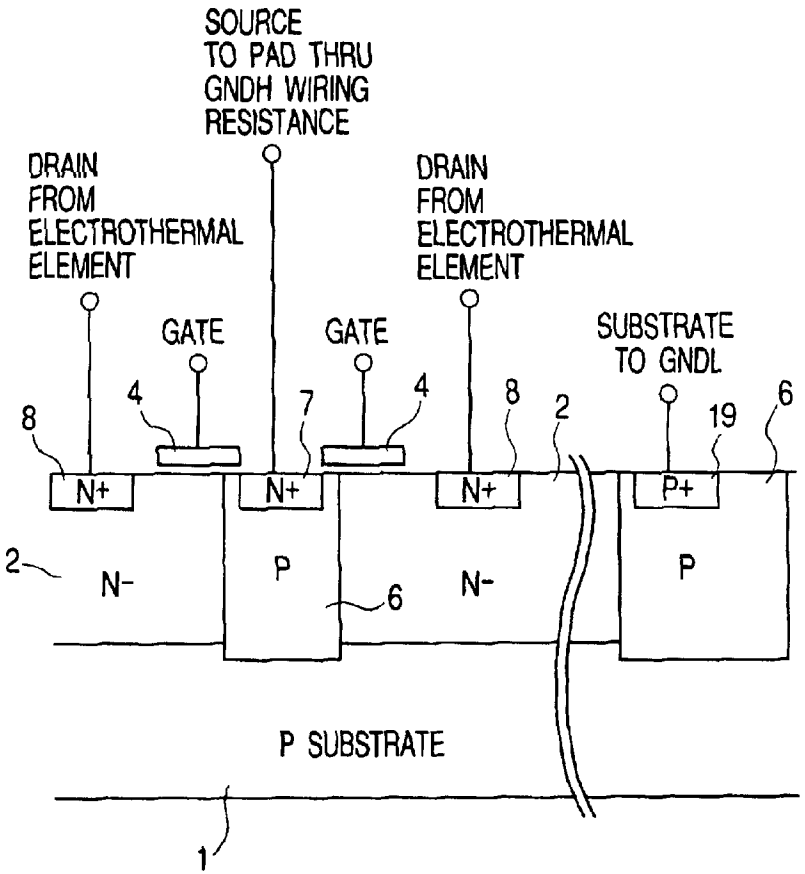
FIGS. 6A and 6B are views for explaining pressure resistance between a source and a substrate in a DMOS transistor.
Figure 6A:
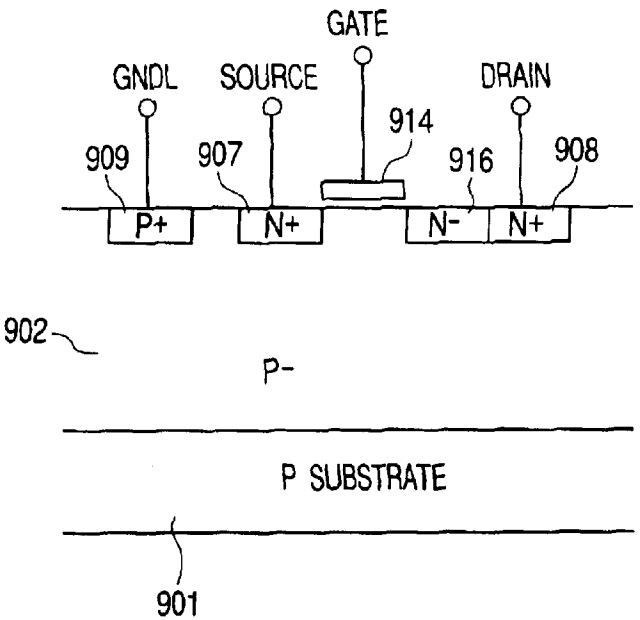
Figure 21:
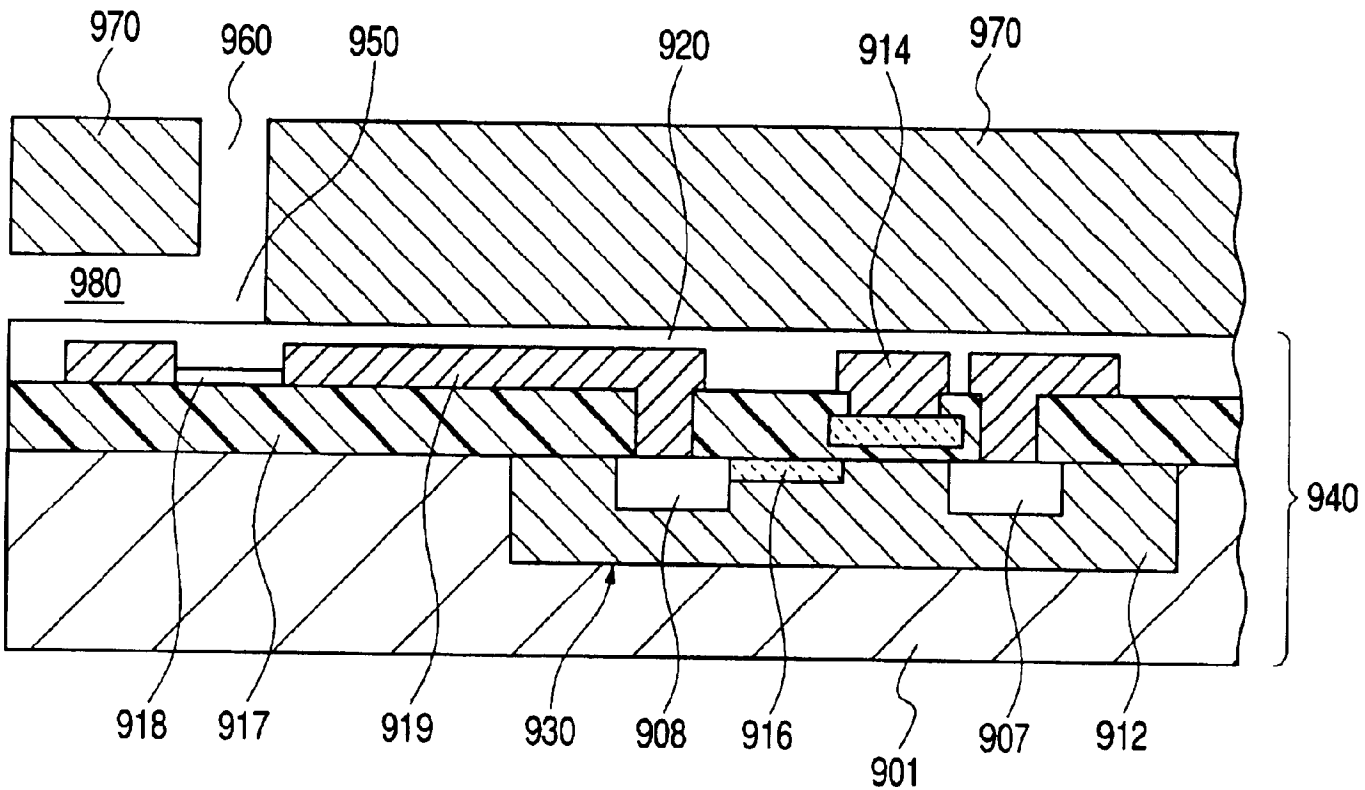
FIG. 21 is a schematic sectional view showing a part of a conventional ink jet recording head.

FIG. 6A is a shows a sectional construction of the conventional MIS-type electric field effect transistor. Although this MIS-type electric field effect transistor is the same as that shown in FIG. 21, in FIG. 6A, it is clearly shown that a p+ diffusing layer 909 is formed on a part of an area surface of a p-type well area 902. The p+ diffusing layer 909 is connected to the ground wiring (GNDL) for defining the substrate potential.

On the other hand, FIG. 6B is a view showing a sectional construction of the switching element 30 according to the illustrated embodiment. Here, the switching element 30 same as shown in FIGS. 1 to 3 are illustrated. However, it is clearly shown that, in order to fix the potential of the semiconductor substrate 1, a base area 6 different from the base area for forming the source area is provided and a P+ diffusing layer 19 for taking out the potential is provided on a part of an area surface of this base area 6.

In the conventional MIS-type electric field effect transistor (switching element) shown in FIG. 6A, even if the potential of the source area 907 is increased by the wiring resistance between the source area 907 and the grounding wiring (GNDH) of the electro-thermal converting element so that the reverse potential is applied to the pn joint area between the source area 907 and the substrate 901 (p-type well area 902), since the p-type impurity density at the side of the p-type well area 902 is low, there was no problem regarding the withstand pressure at the pn joint area.

On the other hand, also in the switching element 30 according to the illustrated embodiment shown in FIG. 6B, if the source potential is higher than the substrate 1, the reverse bias will be applied to the pn joint area between the n-type source area 7 and the p-type base area 6, so that the n-type source area 7 is electrically separated from the semiconductor substrate 1. In the switching element 30 which is the DMOS transistor, the p-type base area 6 forming the channel is connected to the p-type semiconductor substrate 1 and the p-type impurity density in the p-type base area is greater than the impurity density in the p-type well area 902 of the conventional switching element shown in FIG. 6A. Thus, in the switching element 30 according to the illustrated embodiment, the reverse withstand pressure of the pn joint between the source area 7 and the base area 6 (semiconductor substrate 1) was smaller than the reverse withstand pressure of the pn joint between the source area 907 and the p-type well area 902 (semiconductor substrate 901) in the conventional switching element shown in FIG. 6A. Thus, it is required to consider that the voltage (source potential) represented by the product of the wiring resistance $R_S$ of the GDNH wiring and the electric current flowing through the electro-thermal converting element is suppressed.

Figure 7:
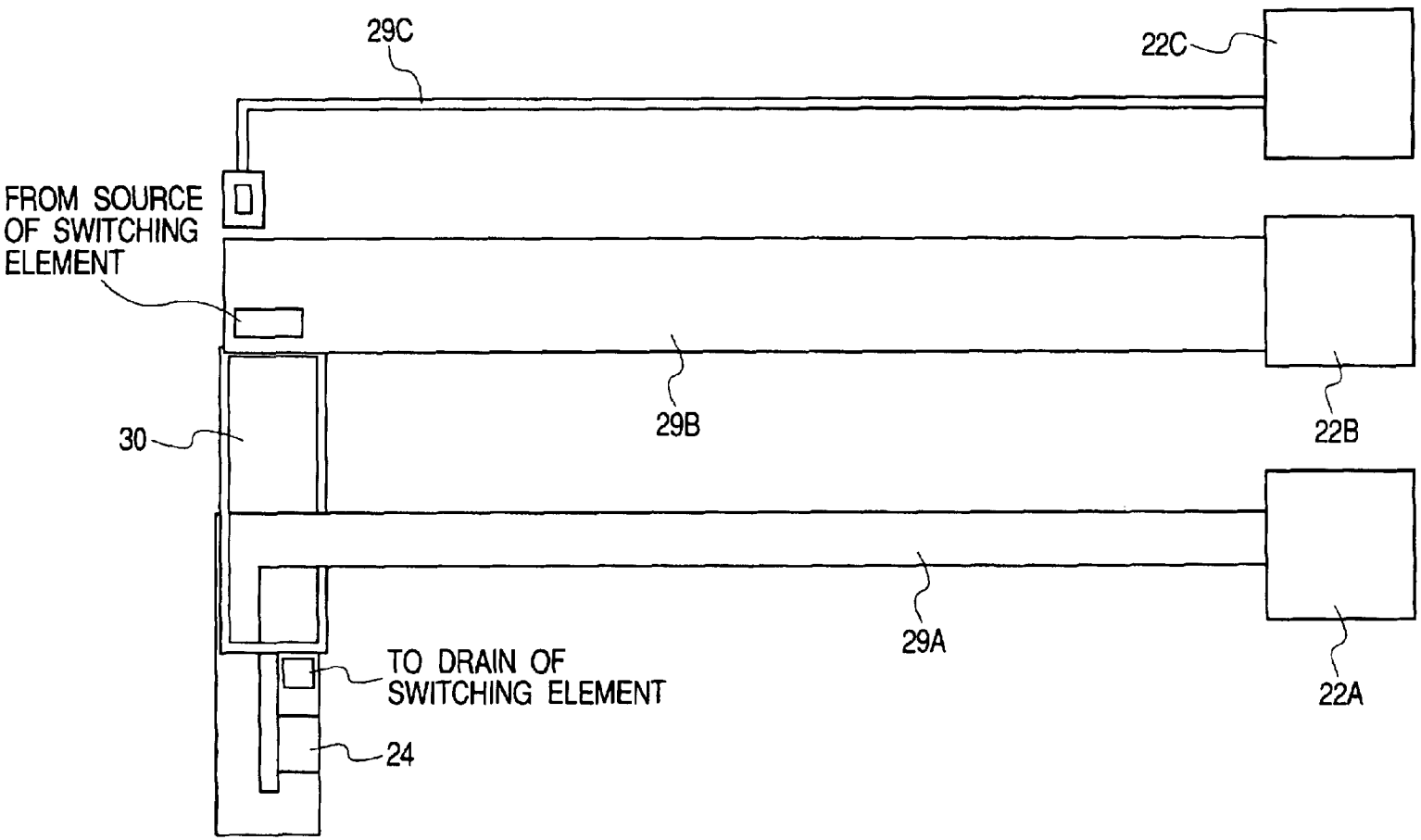
FIG. 7 is an enlarged view showing a main portion (VII) in FIG. 5.

To this end, in the illustrated embodiment, in consideration of the fact that the reverse withstand pressure of the switching element tends to be reduced, as shown in FIG. 7, it is designed so that, in comparison with the a wiring resistance value $R_{VH}$ of the power supply voltage (VH) side wiring for supplying the energy to the electro-thermal converting element 24, i.e. a power wiring 29A for the electro-thermal converting element, a wiring resistance value $R_S$ of the ground (GNDH) wiring 29B for the electro-thermal converting element which is connected to the source area of the switching element 30 to eventually be connected to the ground of the main body of the recording apparatus becomes smaller.

With this arrangement, when the layout of the wirings is carried out in a limited area within which the wiring patterns on the substrate are integrated, the problem regarding the withstand pressure can be reduced effectively.

FIG. 7 corresponds to an enlarged view showing a VII portion in FIG. 5. In order to set such wiring resistance values, as shown in FIGS. 6A and 6B, a width of the wiring made of Al (aluminum) at the GNDH side is set to be wider than the wiring 29A at the VH side. The wiring 29A at the power supply voltage (VH) side is connected to a pad 22A for the power supply voltage and the ground (GNDH) wiring 29B for the electro-thermal converting element is connected to a pad 22B for GNDH. As a result, the pad 22A is connected to the electro-thermal converting element 24 via the wiring resistance $R_{VH}$ of the VH wiring 29A and the pad 22B is connected to the source of the switching element 30 via the wiring resistance $R_S$ of the GNDH wiring 29B. Further, a GNDL wiring 29C for fixing the substrate potential to the grounding potential is provided and this wiring 29C is connected to a pad 22C for GNDL. Here, although the large electric current flow through the GNDH wiring 28B, the large electric current does not flow through the GNDL wiring 29C.

Further, in the illustrated embodiment, not only by reducing the resistance value of the GNDH wiring 29B but also by increasing the power supply voltage value supplied to the electro-thermal converting element 24 by making the best use of the characteristic of the present invention and by setting the resistance value of the electro-thermal converting element to a high value, the electric current values flowing through the VH wiring 29A and the GNDH wiring 29B are reduced without substantially changing the energy consumed in the electro-thermal converting element. In order to increase the resistance value of the electro-thermal converting element 24, according to the illustrated embodiment, as material for the electro-thermal converting element, in place of conventional tantalum nitride, material such as tantalum nitride silicon having high specific resistance and a stable resistance value with respect to heat is adopted. The specific resistance of such material becomes 450 $\mu\Omega\cdot$cm or more, in comparison with the conventional specific resistance lower than 450 $\mu\Omega\cdot$cm. In the illustrated embodiment, when the shape of the electro-thermal converting element 24 is the same as that of the conventional one, by using the material for the electro-thermal converting element having the specific resistance of 800 to 1000 $\mu\Omega\cdot$cm, the sheet resistance value of the electro-thermal converting element becomes 200Ω/□.

Figure 8:
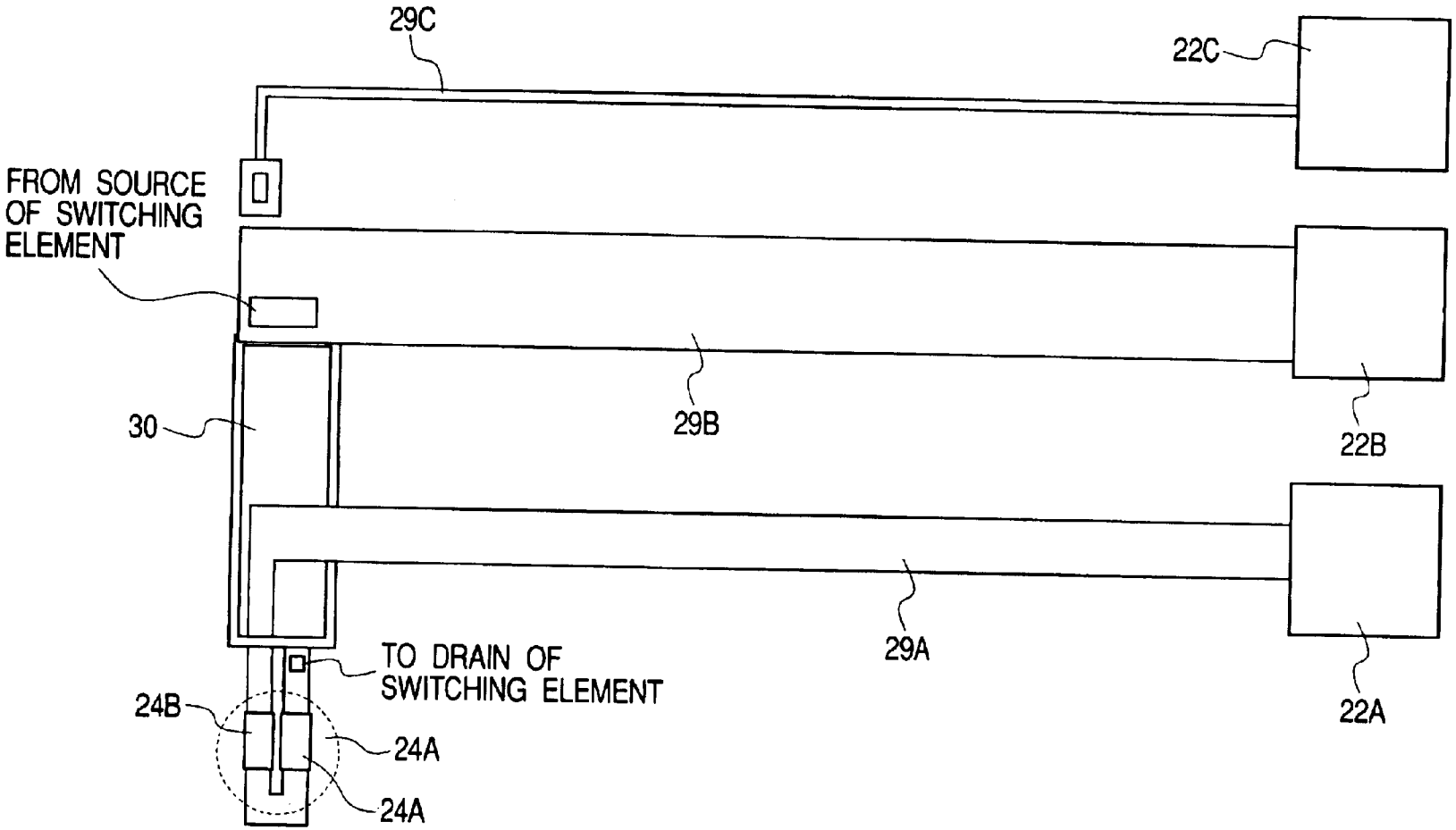
FIG. 8 is another enlarged view of the main portion of FIGS. 6A and 6B showing another constructional example of an electro-thermal converting element.

As another technique for increasing the resistance value, as shown in FIG. 8, there is a technique in which the electro-thermal converting element 24 is constituted so that two or more separated heat generating elements are provided regarding the single switching element 30 and these heat generating elements are connected in series and are disposed adjacent to each other. In the illustrated example, two heat generating elements 24A and 24B are provided. Here, the heat generating element means an element having the same construction as the electro-thermal converting element and serving to apply discharge energy to the liquid (ink) and providing the similar function as the single electro-thermal converting element by combining the plural heat generating elements. The discharge port formed in front of the electro-thermal converting element 24 has a complete circular shape or an elliptical shape near the circular shape. Thus, an excessive elongated shape is not preferred as a heat generating surface for the electro-thermal converting element. In order to increase the resistance value of the electro-thermal converting element while satisfying limitation of the shape of the heat generating surface, in this way, it is preferable that the plurality of heat generating elements 24A and 24B are electrically connected in series and are disposed adjacent to each other to form a single substantially square heat generating surface as a whole.

With this arrangement, an area contributing to the bubbling can have a substantially square shape which is not greatly changed from the conventional shape, and a resistance value as the electro-thermal converting element can be increased greater than the conventional resistance value by about 4 times.

Figure 9:
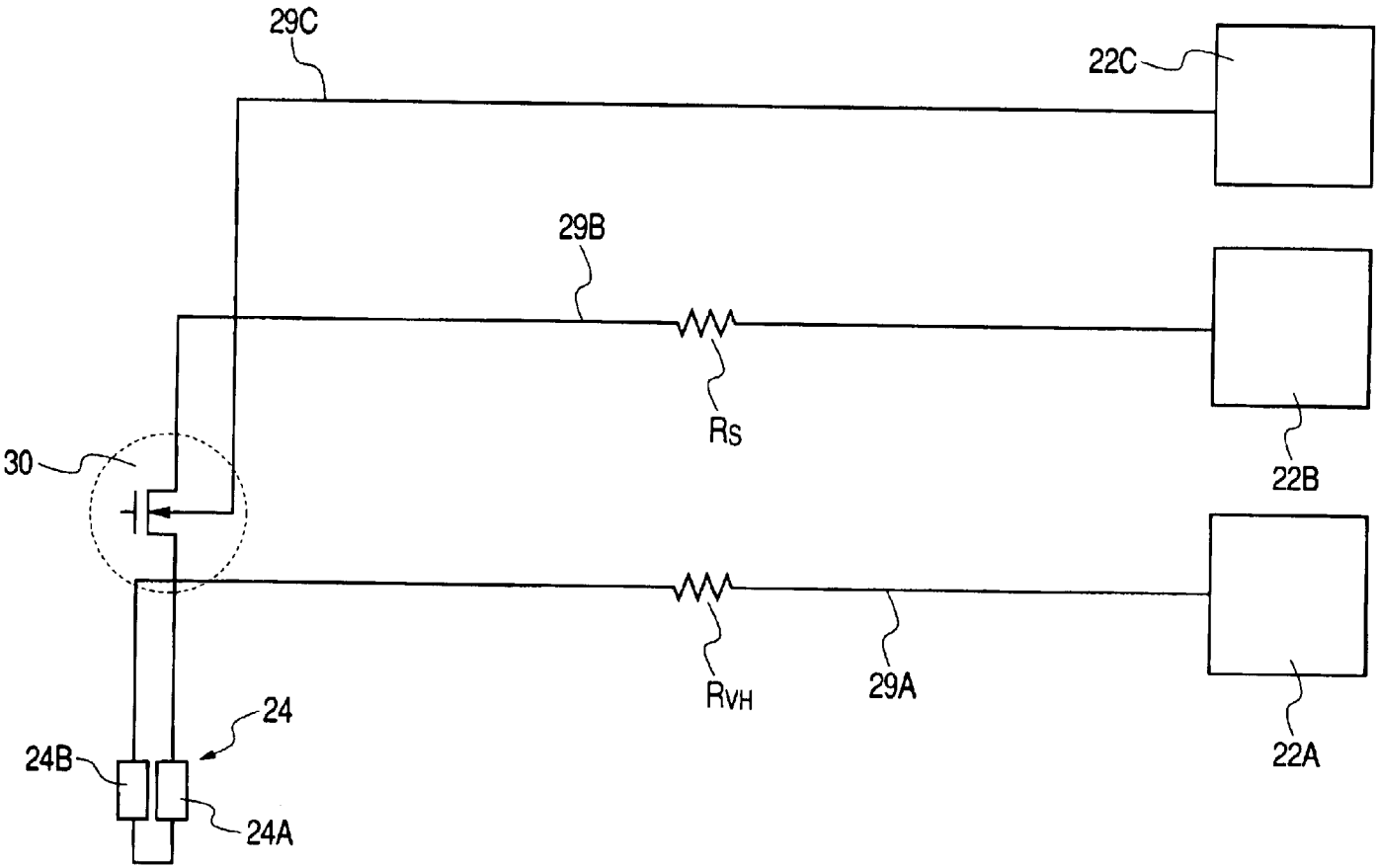
FIG. 9 is an equivalent circuit view showing the construction of FIG. 8.

FIG. 9 is an equivalent circuit diagram corresponding to the construction of FIG. 8. FIG. 9 shows the fact that substrate potential is applied to the switching element 30 from the pad 22C via the potential fixing ground (GNDL) wiring 29C and the pad 22B is connected to the source of the switching element 30 via the wiring resistance $R_S$ of the ground (GNDL) wiring 29B for the electro-thermal converting element and the pad 22A is connected to the electro-thermal converting element 24 via the wiring resistance $R_{VH}$ of the power wiring 29A for the electro thermal converting element. As mentioned above, $R_S$ is smaller than $R_{VH}$.

Next, in comparison with the voltage applied to the conventional electro-thermal converting element and the conventional resistance value, by adopting the construction according to the illustrated embodiment, how the energy saving is achieved will be concretely explained.

In the conventional ink jet recording apparatus, the power supply voltage of 16 to 19 V was used for the electro-thermal converting element. To the contrary, in the illustrated embodiment, since the above-mentioned DMOS transistor can be used as the switching element, as the power supply voltage for the electro-thermal converting element, voltage of 20 to 30 V same as or-similar to the power supply voltage for the motor of the main body of the printing apparatus (recording apparatus) can be used. Here, applied voltage of 24 V was used. In this case, when the resistance value of the electro-thermal converting element is not changed, the electric current flow is increased as the power supply voltage is increased, with the result that, since not only energy consumption in the electro-thermal converting element is increased but also the source potential of the switching element (to the p-type substrate) is increased by the resistance of the wiring for supplying the energy to the electro-thermal converting element, the withstand pressure between the source and the well (substrate) in the switching element also becomes severe. Thus, in the illustrated embodiment, as a resistance thin film constituting the electro-thermal converting element, a thin film having sheet resistance of 200 Ω/□ was used, in place of conventional sheet resistance of 100 Ω/□. The size of the electro-thermal converting element is selected to 37×37 μm. Further, the resistance of the wiring to the electro-thermal converting element is set to 30 Ω at the power supply connecting side (here, 30 Ω is a value obtained by measuring the resistance from the electrode wiring portion at the power supply side near the electro-thermal converting element to the pad of the ink jet recording head substrate) and 10 Ω at the source side of the switching element (here, 10 Ω is a value obtained by measuring the resistance from the wiring portion near the source of the switching element to the pad of the ink jet recording head substrate). In this condition, when the switching element is turned ON, although the electric current of about 100 mA flows, voltage generated at the wiring resistance 10 Ω of the source side is about 1 V. So long as such voltage is generated, the withstand pressure between the source and the substrate can be coped with without any problem.

As another example that the resistance of the electro-thermal converting element is increased, two heat generating element areas each having a size of 12×27 μm are electrically connected in series and these heat elements are disposed adjacent to each other with a distance of about 3 μm therebetween, thereby constituting the electro-thermal converting element having a size of about 27×27 μm. In this case, although material having the sheet resistance of about 80 Ω/□ is used as the electro-thermal converting element, the resistance value thereof becomes about 360Ω (4.5 times), so that the resistance value higher than that obtained when the sheet resistance of 200 Ω/□ is used can be realized and the flowing electric current can be further reduced. By doing so, the source potential can be suppressed within the withstand pressure range between the source and the substrate in the switching element and loss due to the resistance of the wiring portion can be reduced, thereby achieving the whole energy saving.

(Second Embodiment)

A fundamental construction of a semiconductor device (ink jet recording head substrate) for a liquid discharging apparatus according to a second embodiment of the present invention is the same as that in the first embodiment. Main differences between the first embodiment and the second embodiment are positions of the drain areas 8 and 9 and forming processes thereof.

Figure 10:
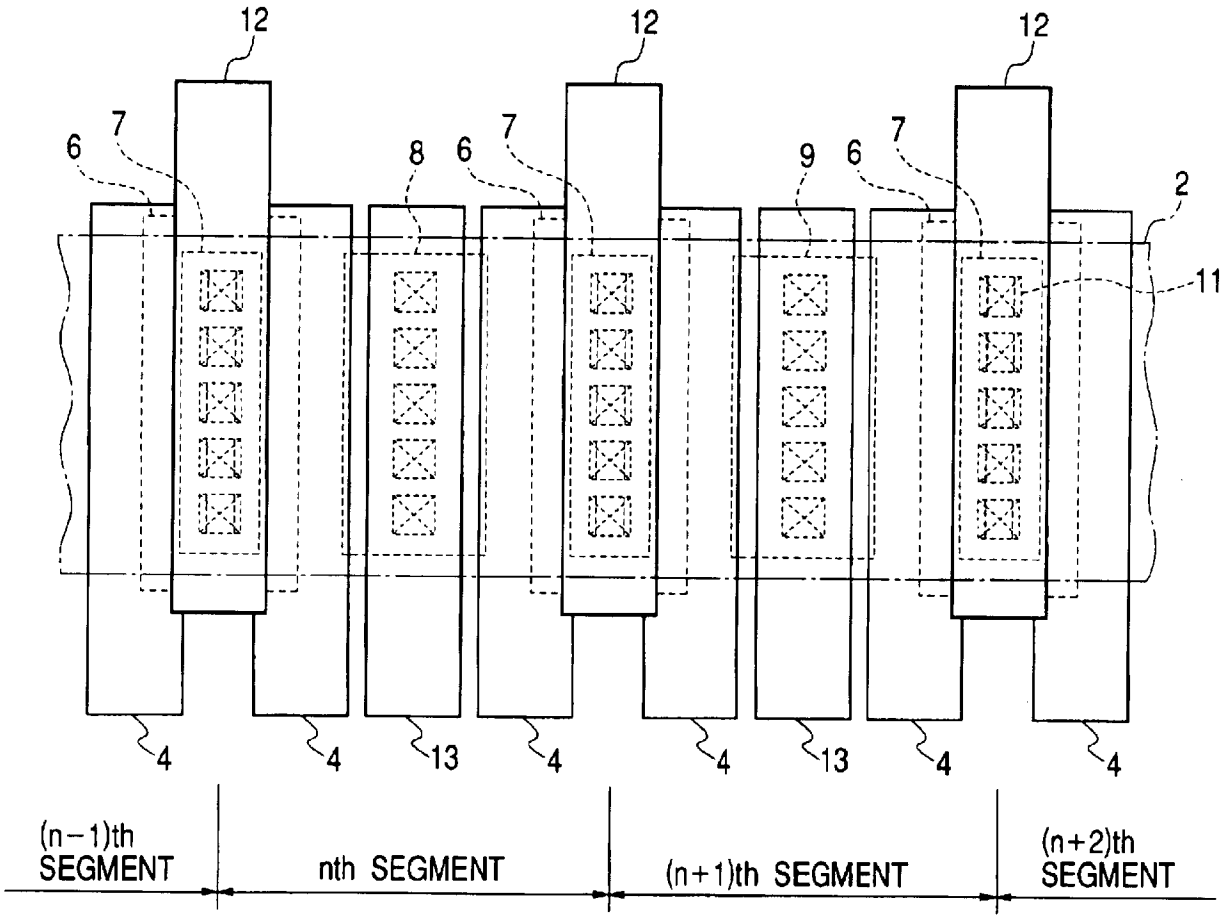
FIG. 10 is a plan view-showing a plan construction of an ink jet recording head substrate according to a second embodiment of the present invention.

FIG. 10 shows a plan construction of an ink jet recording head substrate for a liquid discharging apparatus according to a second embodiment of the present invention and FIGS. 11A, 11B, 11C, 11D and 11E show a sectional construction of the ink jet recording head substrate.

In a method for manufacturing a semiconductor device in which a plurality of electro-thermal converting element and a plurality of switching elements for flowing electric current in the plurality of electro-thermal converting elements are integrated on a first conductive-type semiconductor substrate, a method for manufacturing this ink jet recording head substrate comprises a step (FIG. 11A) for forming a second conductive-type semiconductor layer 2 on one main surface of the first conductive-type semiconductor substrate 1, a step for forming a gate insulation film 203 on the semiconductor layer, a step (FIG. 11B) for forming a gate electrode 4 on the gate insulation film, a step (FIG. 11C) for doping first conductive-type impurity by using the gate electrode as a mask, a step (FIG. 11D) for forming a semiconductor area 6 by spreading the first conductive-type impurity so that it becomes deeper than the second conductive-type semiconductor layer, and a step (FIG. 11E) for forming a second conductive-type source area 7 on the surface of the semiconductor area 6 and second conductive-type drain areas 8 and 9 on the surface of the second conductive-type layer 2 by using the gate electrode as a mask. Now, detailed explanation will be made.

Figure 11A:
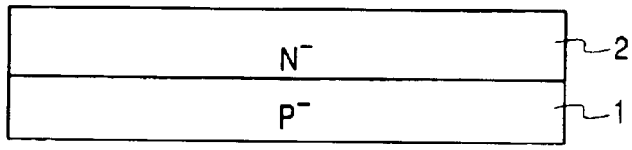
FIGS. 11A, 11B, 11C, 11D and 11E are sectional views showing the ink jet recording head substrate shown in FIG. 10.

First of all, as shown in FIG. 11A, the p-type semiconductor substrate 1 is prepared, and the n-type well areas 2 are formed on the surface of the p-type semiconductor substrate 1 by selectively introducing the n-type impurity to areas where the wells are to be formed. The n-type well areas 2 can be formed on the whole surface of the p-type semiconductor substrate 1.

Further, in a case where the n-type well areas 2 are formed on the whole surface of the p-type semiconductor substrate 1, an epitaxial growing method can be used.

Figure 11B:
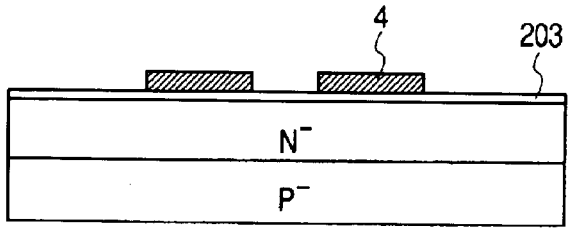

Then, as shown in FIG. 11B, a gate oxide film (gate insulation film) 203 having a film thickness of about 50 nm is grown on the n-type well areas 2, for example, by hydrogen combustion oxidation, and multi-crystal having a film thickness of about 300 nm is deposited on the gate oxide film 203, for example, by an LPCVD (low pressure chemical vapor phase deposition) method. At the same time when the multi-crystal silicon is deposited by the LPCVD method, for example, phosphorus is doped, or after the deposition, for example, phosphorus is doped, for example, by using an ion method or a solid phase dispersing method, thereby obtaining a desired wiring resistance value. Thereafter, the patterning is performed by photolithography, thereby-etching the multi-crystal silicon film. In this way, the gate electrodes 4 of the MIS-type electric field effect transistor can be formed.

Figure 11C:
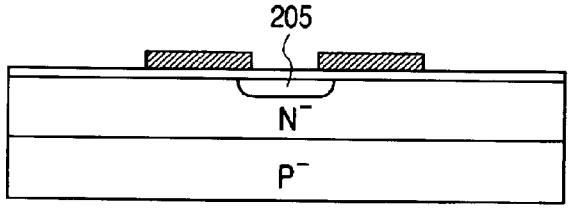

Then, as shown in FIG. 11C, the patterning is performed by photolithography to form a mask (not shown) comprised of photo-resist for the ion driving-in, and, p-type impurity, for example boron, is selectively ion-driven in by using such a mask and by also using the gate electrode 4 as a mask, thereby forming an impurity layer 205.

Figure 11D:
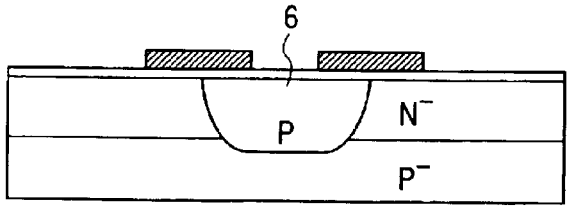

Then, as shown in FIG. 11D, heat treatment is performed within an electric furnace, for example, at a temperature of 1100° C. for 60 minutes, thereby forming the base areas 6 having a depth of about 2.2 $\mu$m for electrically separating the well areas 2 in the lateral direction. In the illustrated embodiment, in this heat treatment, it is important design so that the base areas 6 are deeper than the well areas 2 in order to separate the well areas 2 completely, and the conditions of the heat treatment are determined in accordance with the depth and density of the well areas 2, type of the impurity, or density of the impurity layer 205 and type of the impurity. The depth of the base area 6 used in the present invention can be selected, for example, from a range of about 1 $\mu$m to 3 $\mu$m and the density of the base areas 6 is on the outermost surface can be selected from a range of about $1\times10^{15}/cm^3$ to $1\times10^{19}/cm^3$.

Figure 11E:
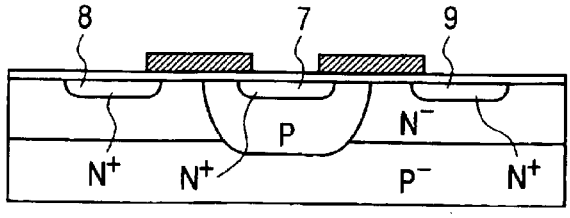

Then, as shown in FIG. 11E, source areas 7, the first drain areas 8 and the second drain areas 9 are formed, for example, by ion-driving in arsenic by using the gate electrode 4 as a mask. In this way, the source areas 7 and the drain areas 8 and 9 are formed with a slight overlapping manner while self-aligning with the gate electrodes.

Thereafter, for example, heat treatment is performed at a temperature of 950° C. for 30 minutes so that the source areas 7, first drain areas 8 and second drain areas 9 are made active.

Thereafter, although not shown, an oxide film is deposited by a CVD (chemical vapor phase deposition) method to form a layer-to-layer insulation film, and contact holes for the contacts 11 (refer to FIG. 10) are opened, and, by depositing and patterning conductor, the wirings are formed. If desired, multi-layer wiring performed, thereby completing the ink jet recording head substrate as the integrated circuit.

The electro-thermal converting elements are manufactured in this wiring forming step by using a well-known thin film process and integrated on the substrate 1. The circuit construction in this case is the same as that in the above-mentioned embodiment.

In the illustrated embodiment, since the base areas 6, source areas 7 and drain areas 8, 9 are formed by using the gate electrode as the ion driving-in mask, these areas are formed in alignment with the gate electrodes, thereby achieving high integration of the switching element array and uniformity of properties of various elements. Further, since the source areas 7 and the drain areas 8, 9 can be formed in the same step, the manufacturing cost can be suppressed.

Figure 12:
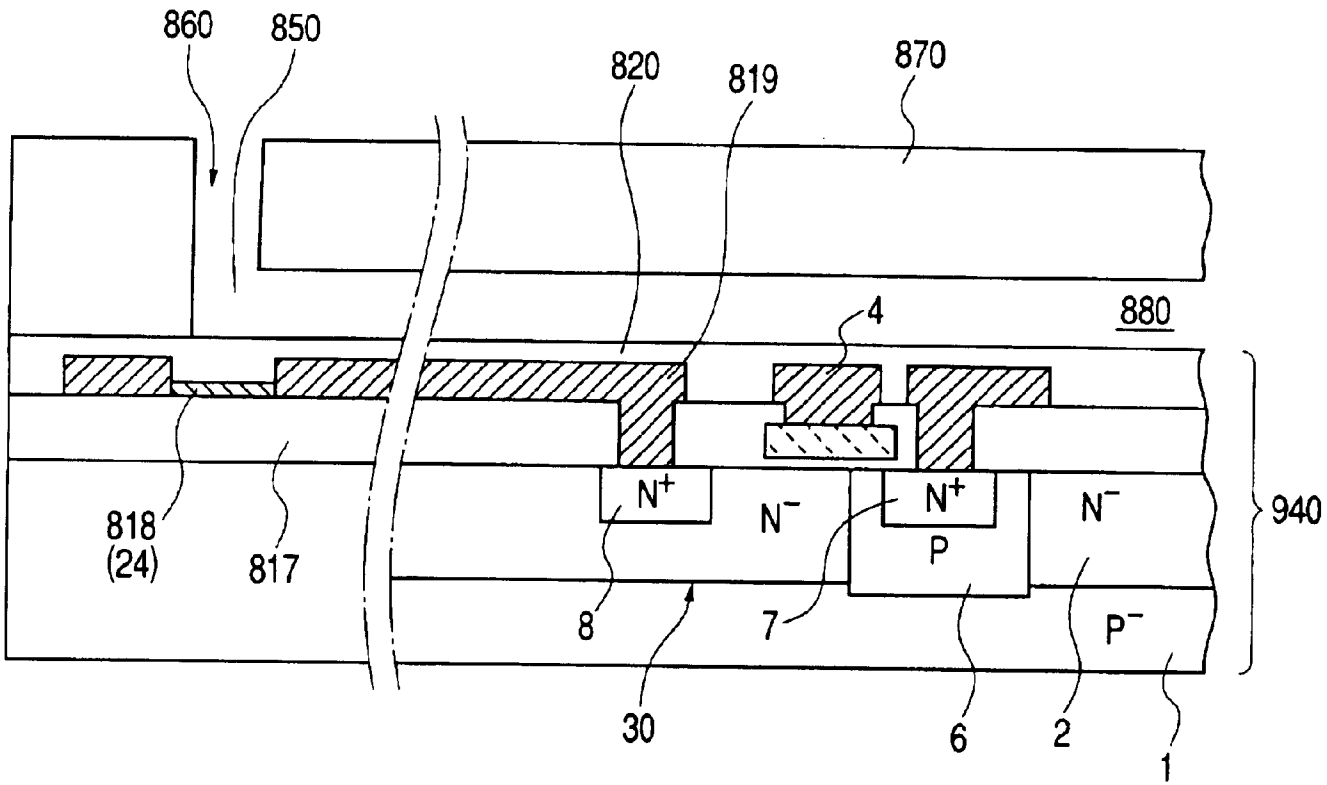
FIG. 12 is a sectional view showing a sectional construction of a part of the ink jet recording head.

FIG. 12 shows an example of a sectional construction of a part of a recording head in a case where the ink jet recording head substrate manufactured by the manufacturing methods shown in FIGS. 1 to 10 and FIGS. 11A to 11E is incorporated into a liquid discharging-apparatus such as the ink jet recording head. Here, although FIG. 12 schematically shows a condition that the n-type well areas 2, gate electrodes 4, p-type base areas 6, n-type source areas 7 and n-type drain areas 8 are provided on the p-type semiconductor substrate comprised of mono-crystal silicon, which areas constitute the MIS (metal insulation semiconductor) type electric field effect transistors 30, as mentioned above, it is preferable that the transistors are arranged in the array without providing exclusive element separating areas between the transistors (segments).

Further, on the semiconductor substrate 1, there are formed an insulation layer 817 acting as a heat accumulating layer and an insulation layer and made of silicon oxide, a heat generating resistance layer 818 such as a tantalum nitride film or a silicon nitride tantalum film, a wiring 819 such as an aluminum alloy film and a protection layer 820 such as a silicon nitride film. In this way, a substrate 940 of the recording head is constituted. Here, the heat generating portion is designated by the reference numeral 850, and the ink is discharged from an ink discharge portion 860. Further, a top plate 870 cooperates with the substrate 940 to define a liquid path 880.

Now, functions of various embodiments of the present invention described above will be explained.

Figure 13:
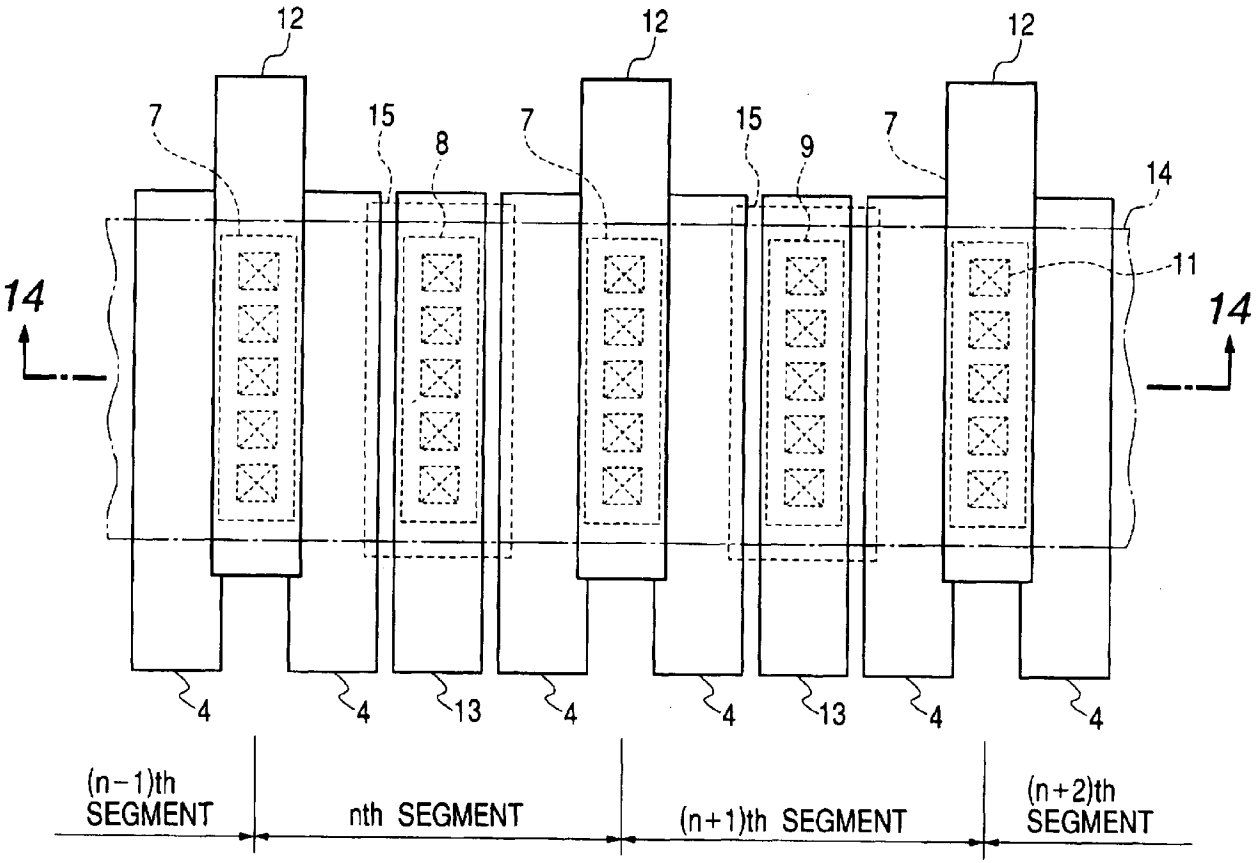
FIG. 13 is a plan view of a MIS-type electric field effect transistor array.
Figure 14:
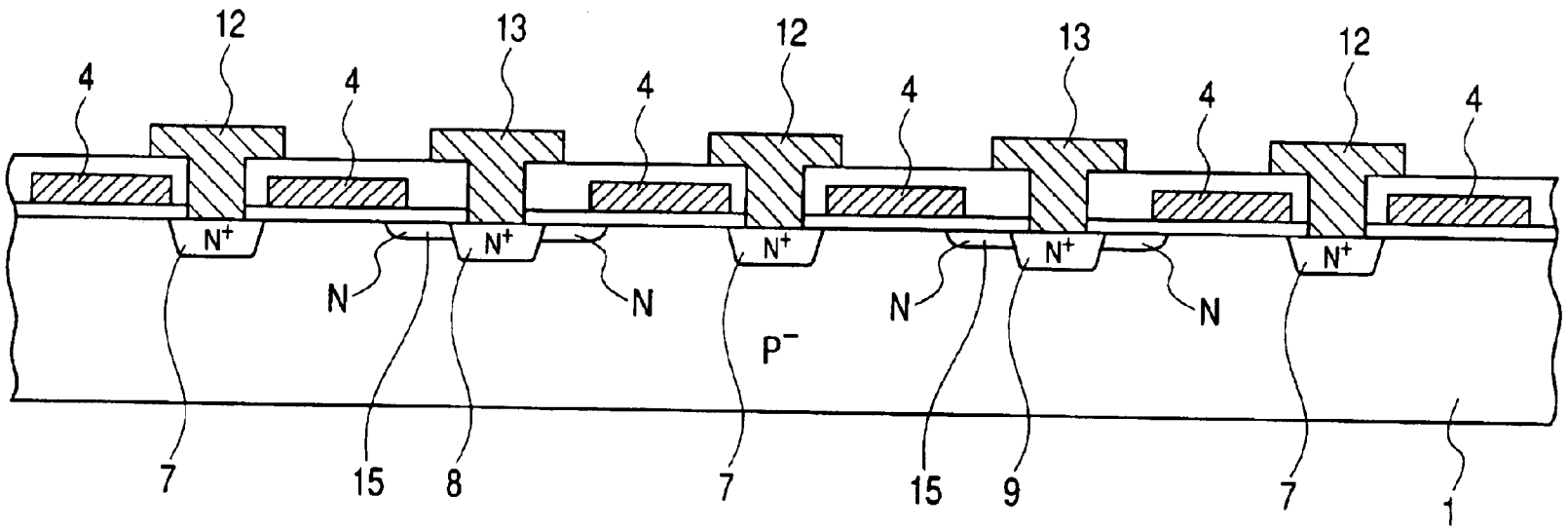
FIG. 14 is a sectional view of the MIS-type electric field effect transistor array shown in FIG. 13.

FIGS. 13 and 14 are a plan view and a sectional view of a certain MIS-type electric field effect transistor array, respectively. By operating the MIS-type electric field effect transistors made in the semiconductor substrate 1 independently or simultaneously, an electrical separating ability between the electro-thermal converting elements interconnected in a matrix fashion can be maintained. Here, it is shown that the gate electrodes 4, n-type source areas 7, n-type drain areas 8, other n-type drain areas 9, contacts 11, source electrodes 12, drain electrodes 13 and n-type electric field relieving drain areas 15 are provided on the semiconductor substrate 1.

However, in the large electric current required for driving the electro-thermal converting elements, if the above-mentioned conventional MIS-type electric field effect transistor,is operated, the pn reverse bias joint between the drain and the well (here, between the drain and the semiconductor substrate) could not endure the high electric field, thereby generating leak electric current, with the result that the withstand voltage required for the ink jet recording head substrate for driving the electro-thermal converting elements could not be satisfied. Further, since the large electric field is used, if ON resistance of the MIS-type electric field effect transistor is great, due to useless consumption of the electric field, the electric current required for operating the electro-thermal converting elements cannot be obtained.

Figure 15:
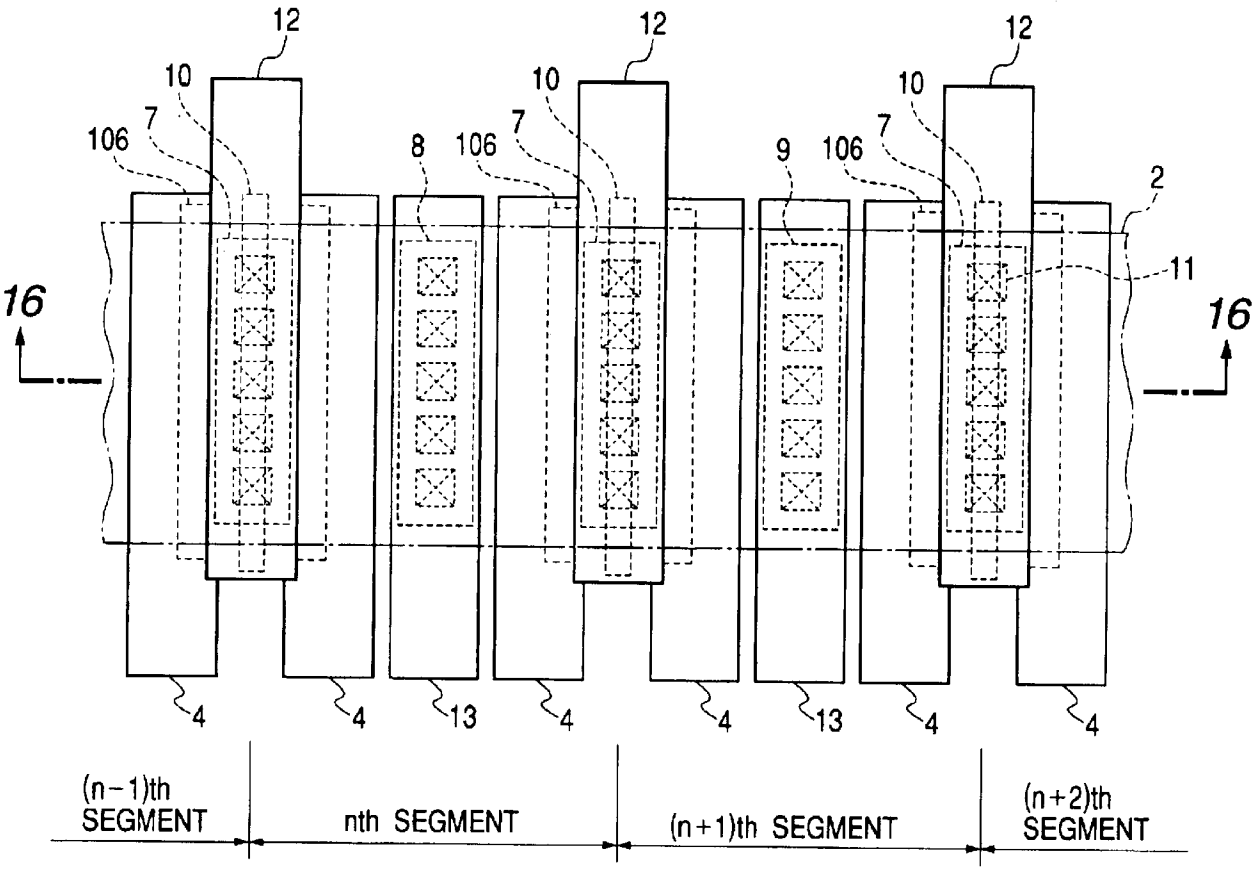
FIG. 15 is a plan view of another MIS-type electric field effect transistor array.
Figure 16:
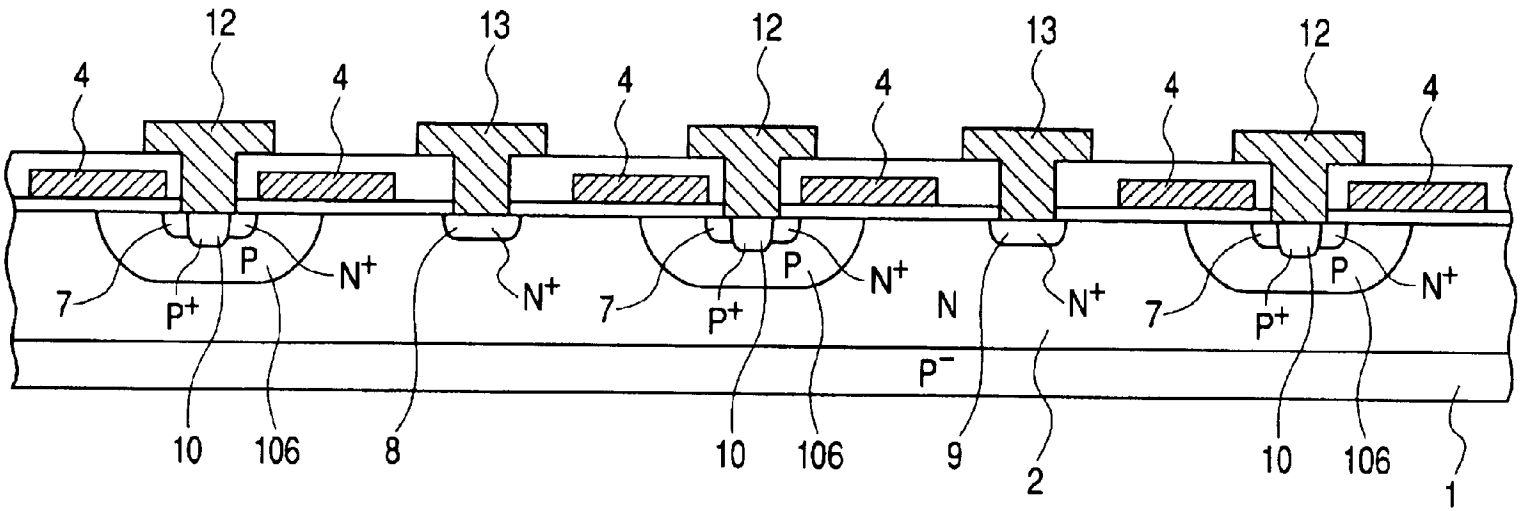
FIG. 16 is a sectional view of the MIS-type electric field effect transistor array shown in FIG. 15.

Further, in order to enhance the withstand pressure, a MIS-type electric field effect transistor array as shown in a plan view of FIG. 15 and sectional view of FIG. 16 can be considered. Here, on the p-type semiconductor substrate 1, there are provided n-type well areas 2, gate electrodes 4, p-type base areas 106, n-type source areas 7, n-type drain areas 8, other n-type drain areas 9, base electrode taking-in layers 10, contacts 11, source electrodes 12 and drain electrodes 13.

The construction of the MIS-type electric field effect transistor differs from the normal construction and is designed so that the depth of the drain determining the withstand pressure is increased by making the channel within the drain and the channels can be made with low density, thereby enhancing the withstand pressure.

However, if the MIS-type electric field effect transistors are arranged as an array, since the drains of the respective transistors are formed by the single common semiconductor layer and all of drain potentials become identical, so long as the exclusive element separating areas are provided between the switching elements which must be operated independently to separate the drains, the electrical separation between the electro-thermal converting element cannot be maintained. Further, such element separating areas try to be newly formed, the process will become complicated and the cost will be increased and further an area forming the elements will be increased. Thus, the construction of the MIS-type electric field effect transistor as shown in FIGS. 15 and 16 is not suited for the transistor array of the liquid discharging apparatus.

On the other hand, according to the ink jet recording head substrate of the embodiments of the present invention as mentioned above, since the density of the drains can be set to be lower than the density of the channels and the drains can be formed well deeply, the large electric current can be used due to high withstand pressure and a high speed operation can be achieved due to low ON resistance and, thus, high integration and great energy saving can be realized. Further, also in the ink jet recording head substrate in which the array construction formed by the plurality of transistors is required, the separation between the elements can easily be achieved without increasing the cost.

Actually, when the present invention and the MIS-type electric field effect transistor having mono-element property similar to the present invention and having the construction shown in FIGS. 15 and 16 are actually laid out by providing the element separating areas to ensure the electrical separation and using the same number of masks and in accordance with a certain same design rule, the MIS-type electric field effect transistor according to the technique shown in FIGS. 15 and 16 requires 12.0 $\mu$m in an array arranging direction in order to form one segment; whereas, in case of the MIS-type electric field effect transistor using the construction of the present invention shown in FIGS. 1 and 2, the length of the array arranging direction is 6.0 $\mu$m, and, thus, the segment can be formed by ½ length. This dimensional ratio (ratio of length in the array arranging direction of the construction shown in FIGS. 1 and 2 with respect to a reference length in the array arranging direction of the construction shown in FIGS. 15 and 16) tends to be reduced as the design rule becomes minute more and more.

{Liquid Discharging Apparatus}

Now, an ink jet printer (ink jet recording apparatus) as the liquid discharging apparatus of the present invention will be explained.

Figure 17:
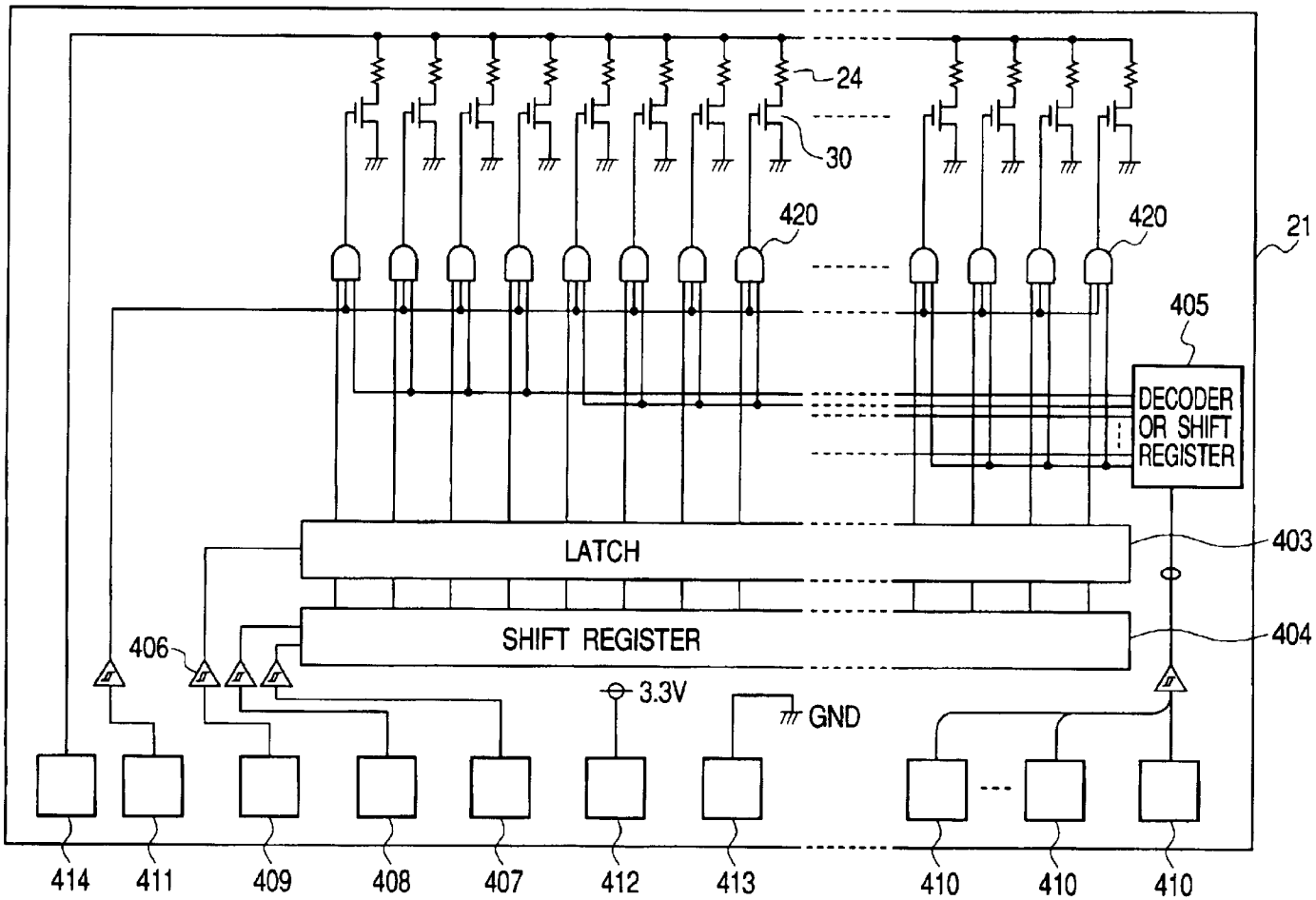
FIG. 17 is a block diagram showing circuits provided on the ink jet recording head substrate.

FIG. 17 is a view showing a circuit construction of the semiconductor device (ink jet recording head substrate) constituting a recording head of the ink jet recording apparatus of the present invention. As the semiconductor device, all of the devices manufactured by the above-mentioned embodiments can be used.

In FIG. 17, the plurality of electro-thermal converting elements 24 are provided on the ink jet recording head substrate 21 and first ends of the electro-thermal converting elements 24 are commonly connected to the driving power supply VH and the other ends are grounded via the switching elements 30 provided in correspondence to the electro-thermal converting elements 24, respectively. A latch circuit 403 and a shift register 404 are provided on the ink jet recording head substrate 21. Further, for the purpose that the power supply device of the main body of the recording apparatus is made more compact by reducing the number of the electro-thermal converting elements 24 simultaneously driven to reduce the electric current instantaneously flown, the group of the electro-thermal converting elements is divided into blocks including a predetermined number of electro-thermal converting elements, and, a time shared drive block selecting logic 405 such as a decoder provided for performing division driving for each block and a logic system buffer 406 having a hysteresis property are formed on the ink jet recording head substrate 21. As input signals, there are clock for driving the shift register, image data input for receiving image data in serial, latch clock for holding data in a latch circuit, a block enable signal for selecting the block, a heat pulse for externally controlling ON time of a power transistor, i.e. time during which the electro-thermal converting element is driven, a logic circuit driving power supply (5 V), a grounding (GND) line and a driving power supply VH, which are inputted via pads 407, 408, 409, 410, 411, 412, 413 and 414 on the substrate, respectively. Further, there is provided an AND circuit 420 in which, for each switching element 30, logic product (AND) of the heat pulse, output of the latch 403 and output from the decoder 405 is obtained to control the switching element 30 on the basis of the result thereby to flow the driving pulse through the electro-thermal converting element 24. Digital image signals inputted from the pad 408 are rearranged in a parallel fashion by the shift register 404 and are latched in the latch circuit 403. When the logic gate becomes enable, in accordance with the signals latched in the latch circuit 403, the switching elements 30 become ON or OFF conditions, thereby flowing the electric current through the selected electro-thermal converting elements 24.

The transistors according to the above-mentioned embodiments can preferably be used as the switching elements. As mentioned above, the exclusive element separating areas are not formed between the switching elements in the switching element array, and, it is preferable that element separating areas such as field insulation films are provided between plural arrays such as between the switching element array and the electro-thermal converting element array and between the switching element array and the logic gate (or latch circuit or shift register).

Figure 18:
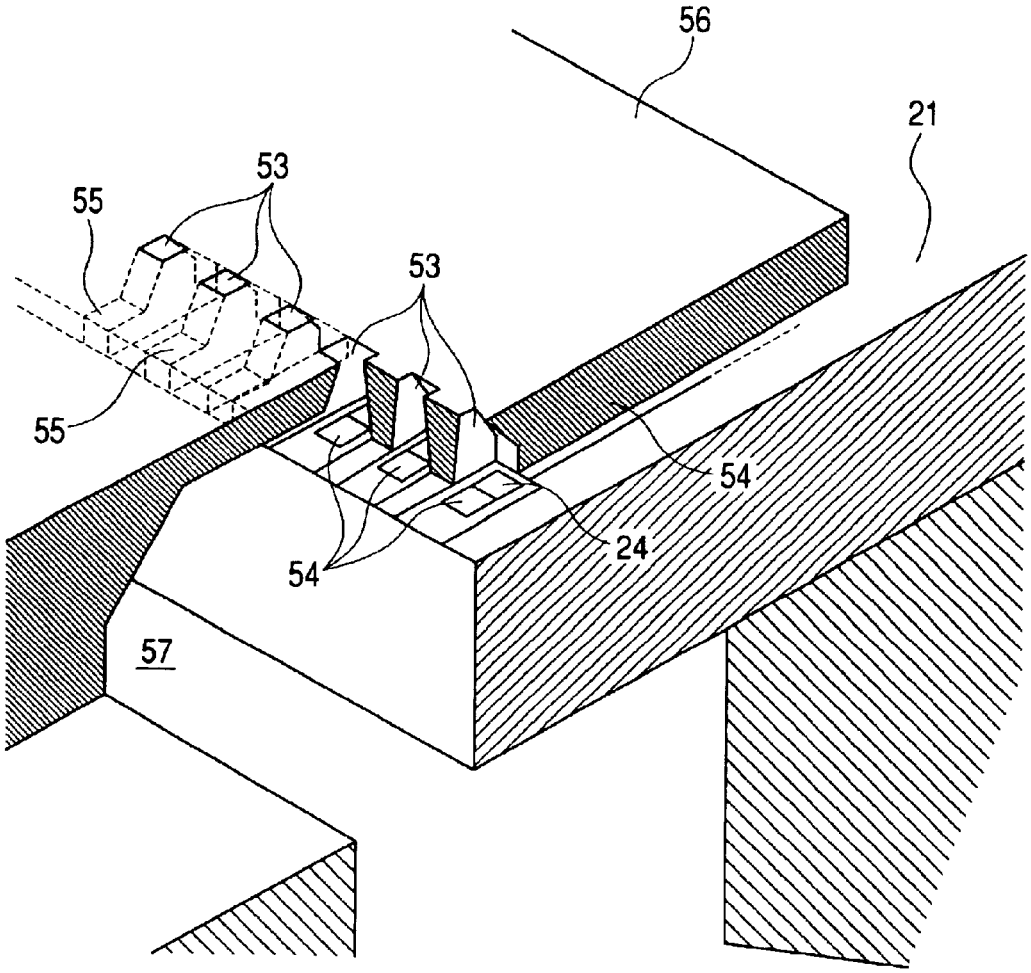
FIG. 18 is a schematic constructional view of an ink jet recording head using the ink jet recording head substrate shown in FIG. 1.

FIG. 18 is a schematic view of the ink jet head. On the ink jet recording head substrate 21 on which the circuits of FIG. 17 are formed, a plurality of electro-thermal converting elements 24 each for generating heat by the electric current and for discharging the ink from discharge port 53 by a bubble generated by the heat are arranged in plural rows. Each electro-thermal converting element is associated with a corresponding wiring electrode 54 and one end of the wiring electrode is electrically connected to the switching element 30. A flow path 55 for supplying the ink to the discharge port 53 opposed to the corresponding electro-thermal converting element 24 is provided in correspondence to the discharge port 53. Walls defining the discharge ports 53 and the flow paths 55 are provided in a grooved member 56, and, by connecting the grooved member 56 to the ink jet recording head substrate 21, a common liquid chamber 57 for supplying the ink to the plural flow paths 55 is defined.

Figure 19:
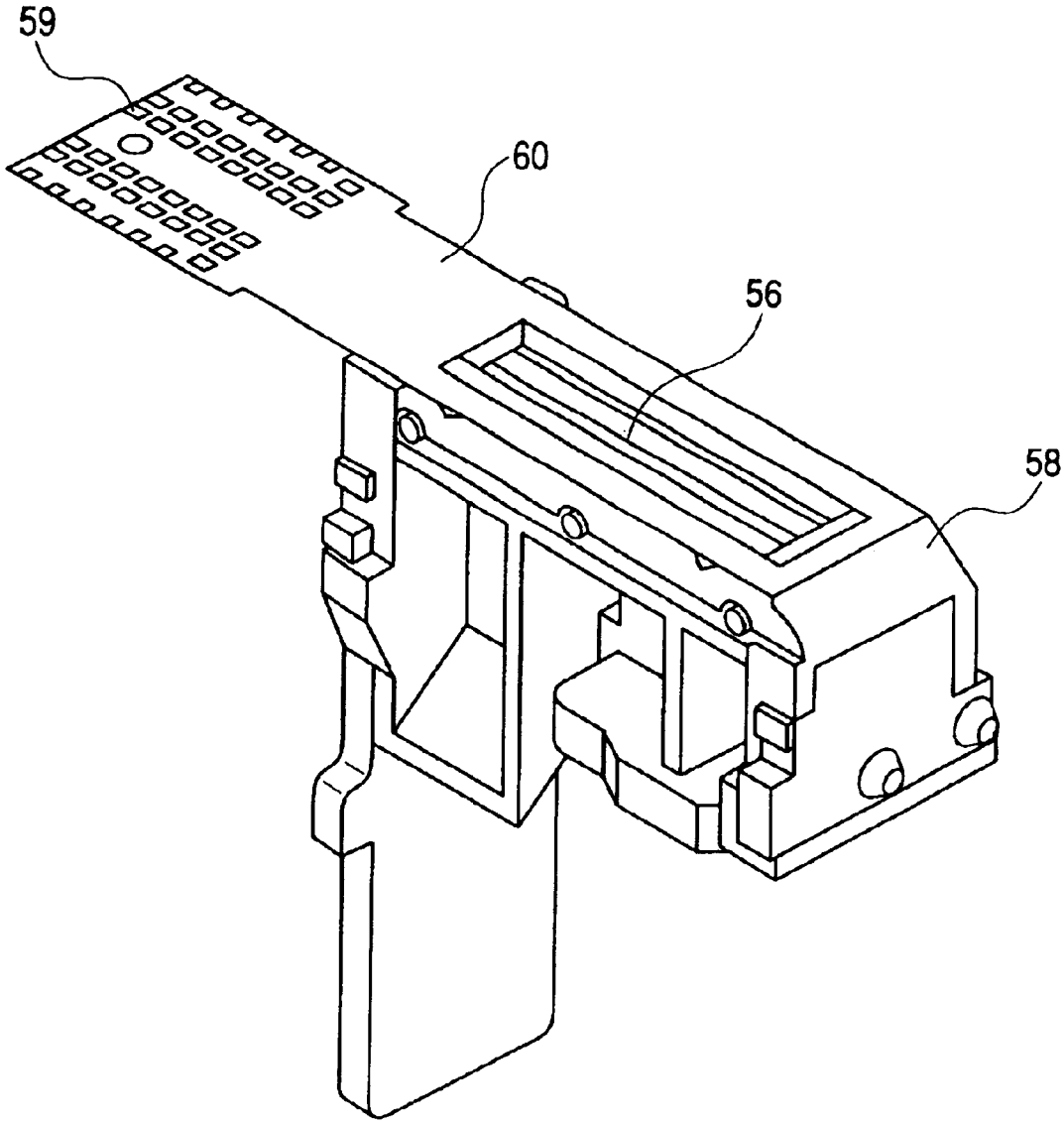
FIG. 19 is a perspective view of the ink jet recording head shown in FIG. 18.

FIG. 19 shows a construction of an ink jet recording head in which the ink jet recording head substrate 21 of the present invention is incorporated, in which the ink jet recording head substrate 21 is incorporated into a frame 58. As mentioned above, the member 56 for defining the discharge ports 53 and the flow paths 55 is attached to the ink jet recording head substrate. Are provided contact pads 59 for receiving electrical signals from the apparatus so that electric signals as various driving signals are supplied to the ink jet recording head substrate 21 via a flexible print wiring substrate 60 from a controller of the main body of the apparatus.

Figure 20:
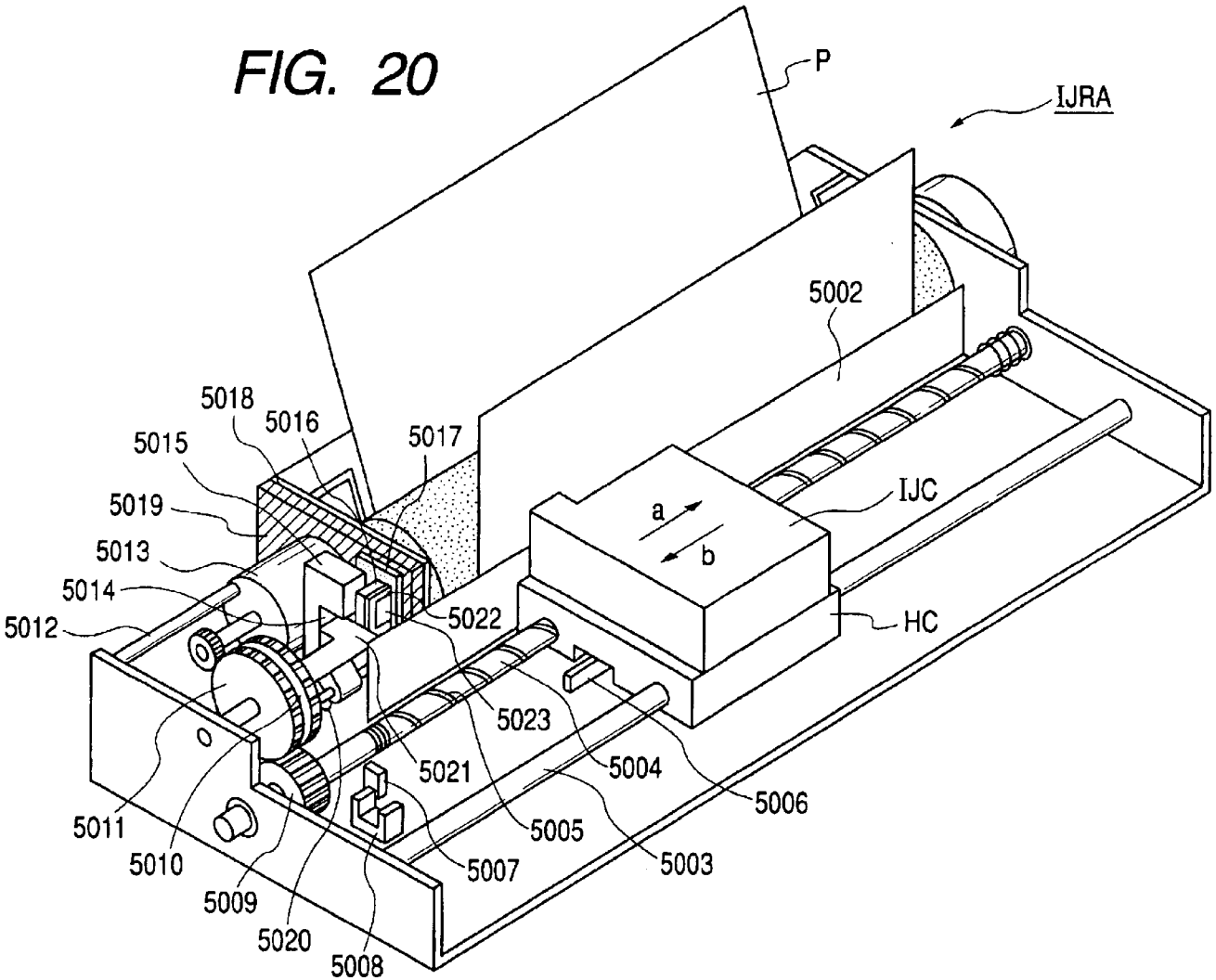
FIG. 20 is a perspective view showing a constructional example of an ink jet recording apparatus using the ink jet recording head shown in FIGS. 18 and 19.

FIG. 20 is a schematic view of an ink jet recording apparatus IJRA to which the ink jet recording head of the present invention is applied.

A carriage HC engaged by a helical groove 5004 of a lead screw 5005 rotated via driving force transmitting gears 5011 and 5009 in synchronous with normal and reverse rotations of a driving motor 5013 detachably mounts the ink jet recording head thereon and has pins (not shown) and is reciprocally shifted in directions shown by the arrows a and b. A paper hold-down plate 5002 serves to urge a print medium (typically, a paper) against a platen 5000 as print medium conveying means throughout a carriage shifting direction. Photo-couplers 5007 and 5008 are home position detecting means for ascertaining the presence of a lever 5006 of the carriage to switch the rotational direction of the motor 5013. A member 5016 serves to support a cap member 5022 for capping a front surface of the ink jet recording head, and suction means 5015 for performing suction from the interior of the cap serves to perform suction recovery of the ink jet recording head via a cap opening 5023. A cleaning blade 5017 and a member 5019 for shifting the blade in a front-and-rear direction are supported by a main body support plate 5018. It should be noted that any well-known cleaning blade other than this blade can be applied to this example. Further, a lever 5012 for starting the suction of the suction recovery is shifted in synchronous with a shifting movement of a cam 5020 engaged by the carriage, and a driving force from the driving motor is shift-controlled by well-known transmitting means such as clutch switching.

Although the capping, cleaning and suction recovery are performed so that, when the carriage reaches a home position area, desired process can be carried out at corresponding positions by the action of the lead screw 5005, so long as the desired operations can be performed at well-known timing, any technique can be applied to this example. The above-mentioned various constructions are excellent inventions independently and in combination and are constructional examples preferable to the present invention.

Incidentally, the recording apparatus includes signal supplying means for supplying a driving signal for driving the heat generating element and other signals to the ink jet recording head (ink jet recording head substrate).

What is claimed is:

1. An ink jet recording head substrate comprising:

a first conductive-type semiconductor substrate on which a plurality of electro-thermal converting elements, first wirings commonly connected to said plurality of electro-thermal converting elements and connected to a driving power supply and adapted to supply an electric power to said plurality of electro-thermal converting elements, second wirings for connecting said plurality of electro-thermal converting elements to grounding potential, and a plurality of switching elements provided between said second wirings and said electro-thermal converting elements and adapted to establish electrical connection to said plurality of electro-thermal converting elements are provided; and wherein said switching element is an insulation gate type electric field effect transistor including:

a second conductive-type first semiconductor area provided on one main surface of said semiconductor substrate;

a first conductive-type second semiconductor area provided on said surface of said semiconductor substrate adjacent to said first semiconductor area to provide a channel area and comprised of semiconductor having impurity density higher than that of said first semiconductor area;

a second conductive-type source area partially provided on a surface of said second semiconductor area opposed to said semiconductor substrate;

a second conductive-type drain area partially provided on a surface of said first semiconductor area opposed to said semiconductor substrate; and a gate electrode provided on said channel area via a gate insulation film;

and further wherein wiring resistance of said second wiring connected to said source area is smaller than wiring resistance of said first wiring connected to said drain area.

2. An ink jet recording head substrate according to claim 1, wherein said second semiconductor area is formed in adjacent to said semiconductor substrate.

3. An ink jet recording head substrate according to claim 1, wherein a wiring width of said second wiring is greater than a wiring width of said first wiring.

4. An ink jet recording head substrate according to claim 1, wherein said source areas and said drain areas are alternately arranged in a lateral direction.

5. An ink jet recording head substrate according to claim 1, wherein said two gate electrodes are disposed with the interposition of said source area.

6. An ink jet recording head substrate according to claim 1, wherein an arranging direction of said plurality of electro-thermal converting elements is in parallel with an arranging direction of said plurality of switching elements.

7. An ink jet recording head substrate according to claim 1, wherein said drain areas of at least two said insulation gate type electric field effect transistors are connected to the single electro-thermal converting element and said source areas of the plurality of said insulation gate type electric field effect transistors are commonly connected.

8. An ink jet recording head substrate according to claim 1, wherein an effective channel length of said insulation gate type electric field effect transistor is determined by a difference in an impurity diffusing amount between said second semiconductor area and said source area in a lateral direction.

9. An ink jet recording head substrate according to claim 1, wherein said electro-thermal converting element includes a plurality of heat generating elements electrically connected in series, and said plurality of heat generating elements connected in series are disposed adjacent to each other.

10. An ink jet recording head substrate according to claim 9, wherein the number of said heat generating elements connected in series is two.

11. An ink jet recording head substrate according to claim 1, wherein said electro-thermal converting element is formed from tantalum nitride silicon material having specific resistance equal to or greater than 450 $\mu\Omega\cdot$cm and sheet resistance is equal to or greater than 70 $\Omega/\square$.

12. An ink jet recording head substrate in which a plurality of electro-thermal converting elements, first wirings commonly connected to said plurality of electro-thermal converting elements and connected to a driving power supply and adapted to supply an electric power to said plurality of electro-thermal converting elements, second wirings for connecting said plurality of electro-thermal converting elements to grounding potential, and a plurality of switching elements provided between said second wirings and said electro-thermal converting elements and adapted to establish electrical connection to said plurality of electro-thermal converting elements are integrated on a semiconductor substrate, and wherein:

said semiconductor substrate is a semiconductor substrate mainly comprising a p-type area; and said switching element is an insulation gate type electric field effect transistor including:

an n-type semiconductor area provided on a surface of a p-type area of said semiconductor substrate;

a p-type semiconductor area extending through said n-type semiconductor area to the surface of said p-type semiconductor area of said semiconductor substrate to provide a channel area and comprised of semiconductor having impurity density higher than that of said n-type semiconductor area;

a high density n-type source area partially provided on the surface of said p-type semiconductor area;

a high density n-type drain area partially provided on a surface of said n-type semiconductor area; and a gate electrode provided on said channel area via a gate insulation film;

and further wherein wiring resistance of said second wiring connected to said source area is smaller than wiring resistance of said first wiring connected to said drain area.

13. An ink jet recording head substrate according to claim 12, wherein a wiring width of said second wiring is greater than a wiring width of said first wiring.

14. An ink jet recording head substrate according to claim 12, wherein said source areas and said drain areas are alternately arranged in a lateral direction.

15. An ink jet recording head substrate according to claim 12, wherein said two gate electrodes are disposed with the interposition of said source area.

16. An ink jet recording head substrate according to claim 12, wherein an arranging direction of said plurality of electro-thermal converting elements is in parallel with an arranging direction of said plurality of switching elements.

17. An ink jet recording head substrate according to claim 12, wherein said drain areas of at least two said insulation gate type electric field effect transistors are connected to the single electro-thermal converting element and said source areas of the plurality of said insulation gate type electric field effect transistors are commonly connected.

18. An ink jet recording head substrate according to claim 12, wherein an effective channel length of said insulation gate type electric field effect transistor is determined by a difference in an impurity diffusing amount between said second semiconductor area and said source area in a lateral direction.

19. An ink jet recording head substrate according to claim 12, wherein said electro-thermal converting element includes a plurality of heat generating elements electrically connected in series, and said plurality of heat generating elements connected in series are disposed adjacent to each other.

20. An ink jet recording head substrate according to claim 19, wherein the number of said heat generating elements connected in series is two.

21. An ink jet recording head substrate according to claim 12, wherein said electro-thermal converting element is formed from tantalum nitride silicon material having specific resistance equal to or greater than 450 $\mu\Omega\cdot$cm and sheet resistance is equal to or greater than 70 $\Omega/\square$.

22. An ink jet recording head comprising:

an ink jet recording head substrate according to any one of claims 1 to 21 and in which discharge ports corresponding to said electro-thermal converting elements are formed; and a liquid collecting container for containing liquids discharged from said discharge ports by said electro-thermal converting elements.

23. An ink jet recording apparatus comprising:

an ink jet recording head according to claim 22; and a controller for supplying energy and driving control signals to said electro-thermal converting elements of said ink jet recording head.

24. An ink jet recording apparatus according to claim 23, wherein voltage of a power supply for supplying the energy to said electro-thermal converting elements is identical to voltage of a power supply for a motor for driving said ink jet recording head.

* * * * *